US012611609B1

(12) United States Patent
Lopez et al.

(10) Patent No.: US 12,611,609 B1
(45) Date of Patent: Apr. 28, 2026

(54) TOY VEHICLE ACCESSORY TRACK PIECES

(71) Applicant: Mattel, Inc., El Segundo, CA (US)

(72) Inventors: Gabriel Lopez, Los Angeles, CA (US); Joshua Graves, Hermosa Beach, CA (US); Giang-Son Quoc Nguyen, Buena Park, CA (US); Gabriel De La Torre, Los Angeles, CA (US); Eric So, Kowloon (HK); Benny Huang, Shenzhen (CN); Owen Zhang, Shenzhen (CN); Neo Liu, Shenzhen (CN); Jeremy Fischer, Long Beach, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 19/214,594

(22) Filed: May 21, 2025

(51) Int. Cl.

| | |
|---|---|
| ***A63H 18/14*** | (2006.01) |
| ***A63H 18/02*** | (2006.01) |
| ***A63H 18/08*** | (2006.01) |
| *A63H 29/22* | (2006.01) |
| *A63H 31/04* | (2006.01) |

(52) U.S. Cl.
CPC ..... *A63H 18/14* (2013.01); *A63H 18/025* (2013.01); *A63H 18/028* (2013.01); *A63H 18/08* (2013.01); *A63H 29/22* (2013.01); *A63H 31/04* (2013.01)

(58) Field of Classification Search
CPC .... A63H 18/00; A63H 18/023; A63H 18/025; A63H 18/026; A63H 18/028; A63H 18/06; A63H 18/08; A63H 18/14; A63H 18/16
See application file for complete search history.

(56) References Cited

U.S. PATENT DOCUMENTS

| | | | | |
|---|---|---|---|---|
| 1,576,140 A * | 3/1926 | Schneider | ..... | A63F 7/3622 273/120 R |
| 3,377,958 A * | 4/1968 | Bax | ..... | A63H 18/023 238/10 F |
| 3,456,596 A * | 7/1969 | Cooper | ..... | A63H 18/023 104/53 |
| 3,559,335 A | 2/1971 | See et al. | | |

(Continued)

FOREIGN PATENT DOCUMENTS

| | | | | |
|---|---|---|---|---|
| CN | 102247699 B | 2/2014 | | |
| EP | 1710003 A1 * | 10/2006 | ..... | A63H 18/025 |

(Continued)

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A toy vehicle track configuration includes a closed loop track extending from a first end to a second end, a booster, and a flexible diverter. The booster includes a booster wheel positioned to both: (i) propel a toy vehicle towards the second end as the toy vehicle moves from the first end towards the second end; and (ii) propel the toy vehicle towards the first end as the toy vehicle moves from the second end towards the first end. The flexible diverter is configured to guide the toy vehicle and an additional toy vehicle towards the booster in sequence as the toy vehicle and the additional toy vehicle move from the first end towards the second end. The flexible diverter is configured to pivot between gate positions and to move between a rest position and a compressed position.

18 Claims, 21 Drawing Sheets

(56) References Cited

U.S. PATENT DOCUMENTS 3,590,524 A * 7/1971 Beny ..... A63H 18/14 104/168
3,599,365 A 8/1971 Carver et al.
3,600,849 A 8/1971 Faller
3,636,651 A * 1/1972 Lohr ..... A63H 18/14 446/429
3,641,704 A * 2/1972 Sims ..... A63H 18/14 124/78
3,712,615 A * 1/1973 Staats ..... A63H 18/005 235/98 B
3,751,847 A * 8/1973 Neuhierl ..... A63H 18/14 446/429
3,777,394 A * 12/1973 Staats ..... A63H 18/005 446/487
3,857,193 A * 12/1974 Goldgarb ..... A63H 18/02 446/436
4,174,587 A 11/1979 Gabler et al.
4,199,893 A * 4/1980 Rittinger ..... A63H 18/026 104/253
4,383,688 A * 5/1983 Prehodka ..... A63H 18/028 238/10 F
4,475,303 A 10/1984 Ribas et al.
4,564,197 A 1/1986 Lambert et al.
5,052,972 A 10/1991 Suimon et al.
5,165,347 A 11/1992 Wagner
5,299,969 A 4/1994 Zaruba
5,683,298 A * 11/1997 Jackson ..... A63H 18/02 463/58
5,767,655 A * 6/1998 Ostendorff ..... A63H 29/22 446/429
5,899,789 A 5/1999 Rehkemper et al.
6,089,951 A 7/2000 Ostendorff
6,241,573 B1 6/2001 Ostendorff et al.
6,695,675 B1 * 2/2004 Ngan ..... A63H 17/008 446/444
6,793,554 B1 9/2004 Newbold
7,387,559 B2 6/2008 Sanchez-Castro et al.
7,637,796 B2 12/2009 Hippely
7,901,266 B2 3/2011 Ostendorff
8,342,903 B2 1/2013 O'Connor et al.
8,366,508 B2 2/2013 Filoseta et al.
8,944,881 B2 * 2/2015 Payne ..... A63H 18/028 446/444
9,302,193 B2 4/2016 Chang et al.
9,586,154 B2 3/2017 Lau et al.
10,596,476 B2 * 3/2020 Ostendorff ..... A63H 18/026
11,426,670 B2 * 8/2022 Kenney ..... A63H 17/008
11,426,671 B2 * 8/2022 Cao ..... A63H 33/044
11,491,412 B2 * 11/2022 Cao ..... A63H 18/14
2004/0198166 A1 * 10/2004 Newbold ..... A63H 18/16 446/429
2005/0191938 A1 9/2005 Sheltman et al.
2005/0191939 A1 9/2005 Sheltman et al.
2005/0191940 A1 9/2005 Sheltman et al.
2005/0287914 A1 12/2005 Sheltman et al.
2005/0287915 A1 12/2005 Sheltman et al.
2005/0287916 A1 12/2005 Sheltman et al.
2005/0287917 A1 12/2005 Sheltman et al.
2005/0287918 A1 12/2005 Sheltman et al.
2005/0287919 A1 12/2005 Sheltman et al.
2009/0117821 A1 5/2009 Ogihara
2012/0264350 A1 10/2012 Ostendorff et al.
2018/0229136 A1 8/2018 Cherednichenko et al.

FOREIGN PATENT DOCUMENTS

WO 2005009570 A3 12/2005
WO 2009060258 A2 5/2009

* cited by examiner

TOY VEHICLE ACCESSORY TRACK PIECES

FIELD OF THE INVENTION

The present invention relates to a toy vehicle track with which a toy vehicle can be used and in particular, to toy vehicle track with accessory track pieces that facilitate race play at increased toy vehicle speeds.

BACKGROUND OF THE INVENTION

Conventional toy vehicle track sets include one or more sections of track along which a toy vehicle can travel. In some instances, a track configuration is built from modular pieces of track that allow an end user to build a variety of play configurations. Additionally or alternatively, accessories that act on a toy vehicle may be incorporated into play configurations. The accessories may act on a toy vehicle when the toy vehicle is traveling along a track path or when the toy vehicle reaches the end of a track path. End users (e.g., children), however, can lose interest in accessories over time. Thus, new accessories and/or new track features are continuously desirable, especially if such accessories and/or features enable new play patterns, such as play patterns in which toy vehicles travel faster and/or more competitively along a toy vehicle track set.

SUMMARY OF THE INVENTION

Toy vehicle accessory track pieces are disclosed herein. According to one embodiment, the toy vehicle accessory track pieces are included in a toy vehicle track configuration. For example, a toy vehicle track configuration may include a closed loop track, a booster, and a flexible diverter. The closed loop track extends from a first end to a second end. The booster includes a booster wheel positioned to both: (i) propel a toy vehicle towards the second end as the toy vehicle moves from the first end towards the second end; and (ii) propel the toy vehicle towards the first end as the toy vehicle moves from the second end towards the first end. The flexible diverter is configured to guide the toy vehicle and an additional toy vehicle towards the booster in sequence as the toy vehicle and the additional toy vehicle move from the first end towards the second end. The flexible diverter is configured to pivot between gate positions and to move between a rest position and a compressed position. Among other advantages, this toy vehicle track configuration may provide or create play patterns in which toy vehicles travel faster and/or more competitively along a toy vehicle track.

In some of these embodiments, the flexible diverter moves to one of the gate positions when contacted by one of the toy vehicle or the additional toy vehicle. That is, a leading vehicle may contact the flexible diverter and cause the flexible diverter to move into a gate position that blocks the path of another vehicle against which the toy vehicle is racing.

Additionally or alternatively, the flexible diverter may move from the rest position to the compressed position when contacted by both the toy vehicle and the additional toy vehicle. Thus, when a trailing or latter vehicle impacts the diverter shortly after a lead toy vehicle, the diverter will not be static. Instead, the diverter will move in response to an impact from a latter or trailing toy vehicle. By moving from the rest position to the compressed position, the flexible diverter reduces an impact force applied by the flexible diverter to a latter toy vehicle of the toy vehicle and the additional toy vehicle to impact the flexible diverter. This reduction in the impact force discourages the latter toy vehicle from exiting the closed loop track in response to impacting the flexible diverter (e.g., via ejecting, jumping, etc.). This is important when a user (e.g., a child) is trying to simulate a continuous, competitive race between two vehicles. By comparison, if one vehicle experiences a high impact force and departs the track, the race is temporarily suspended and requires user intervention to restart.

Still further, in some embodiments, the booster includes a first pathway and a second pathway, with the first pathway being configured to direct the toy vehicle into contact with the booster wheel as the toy vehicle moves from the second end towards the first end and the second pathway being configured to direct the toy vehicle into contact with the booster wheel as the toy vehicle moves from the first end towards the second end. Thus, a single booster wheels can propel a toy vehicle in two directions, maintaining the vehicle's speed along different portions of a track. This ensures that enhanced play value is provided efficiently and cost effectively. By comparison, known toy vehicle systems often require separate booster wheels, if not two wheels per pathway, when propelling vehicles in different directions, increasing the cost and complexity of these systems.

In some instances, the booster may comprise a second booster wheel. The first booster wheel may extend into a second pathway along a first side of the second pathway and the second booster wheel may extend into the second pathway along a second side of the second pathway, opposite the first side of the second pathway. Thus, the two booster wheels may work together to propel a toy vehicle, adding extra force and encouraging the toy vehicle to be propelled straight ahead. To achieve this, the booster wheel and the second booster wheel may rotate in opposite rotational directions.

Additionally or alternatively, the booster of the present application can provide three boosted lanes with three booster wheels. For example, the booster may comprise a third pathway positioned to allow the toy vehicle to move through the booster without contacting the booster wheel. Instead, the booster may comprise a third booster wheel positioned to propel the toy vehicle towards the first end as the toy vehicle moves along the third pathway from the second end towards the first end. That is, separate booster wheels may contact two vehicles moving in the same direction, allowing two vehicles to race. In at least some embodiments, the booster wheel and the third booster wheel rotate in opposite rotational directions, e.g., if these booster wheels are spaced apart and engaging opposite sides of their respective tracks. Moreover, in some embodiments, the third booster wheel can be incorporated in the accessory track piece without a second booster wheel. In such embodiments, two booster wheels can boost toy vehicles across three, or even four, boosted pathways.

According to another embodiment of the present application, a toy vehicle accessory track piece comprises a main body defining a first pathway and a second pathway, and a booster wheel. The booster wheel is configured to both: (i) engage and propel a toy vehicle in a first direction as the toy vehicle moves along the first pathway; and (ii) engage and propel the toy vehicle in a second direction, opposite the first direction, as the toy vehicle moves along the second pathway. In at least some instances, the booster wheel is configured to engage and propel the toy vehicle in the first direction as the toy vehicle moves along the first pathway while simultaneously engaging and propelling an additional toy vehicle in the second direction as the additional toy vehicle moves along the second pathway. This accessory track piece may include any of the features and realize any of the advantages discussed herein.

According to yet another embodiment of the present application, a toy vehicle accessory track piece comprises a flexible diverter configured to: (a) pivot between gate positions that each open one toy vehicle path while closing another toy vehicle path, wherein the flexible diverter moves to one of the gate positions when contacted by a single toy vehicle; and (b) move between a rest position and a compressed position, wherein the flexible diverter moves from the rest position to the compressed position when contacted by two toy vehicles. In some embodiments, the toy vehicle accessory track piece also includes a track piece with a convergent track pathway including an entrance that allows the two toy vehicles to enter the track piece in parallel and an exit that forces the two toy vehicles to exit the track piece in sequence. Additionally or alternatively, this accessory track piece may include any of the features and realize any of the advantages discussed herein. For example, the flexible diverter may comprise a first vehicle guide movably coupled to a second vehicle guide via a biasing member, with the biasing member biasing the first vehicle guide and the second vehicle guide to the rest position while allowing the first vehicle guide and the second vehicle guide to move towards each other to move into the compressed position.

Further features and advantages are described below.

BRIEF DESCRIPTION OF THE DRAWINGS

Like reference numerals have been used to identify like elements throughout this disclosure.

DETAILED DESCRIPTION OF THE INVENTION

Overall, the present application is directed to new accessory track pieces for toy vehicles. The new accessory track pieces are intended to facilitate new play patterns in which toy vehicles travel faster and/or more competitively along a toy vehicle track set. The new accessory track pieces presented herein encourage toy vehicles to quickly and competitively traverse a toy vehicle track configuration by efficiently propelling the toy vehicles in multiple locations and in multiple directions and/or by allowing smooth and seamless passing or "overtaking." At the same time, the new accessory track pieces of the present application maintain the toy vehicles on the track, discouraging toy vehicles from leaving or ejecting from the track, so that toy vehicles can repeatedly compete to win a race. Further features and advantages of the track pieces are described below.

Figure 1:
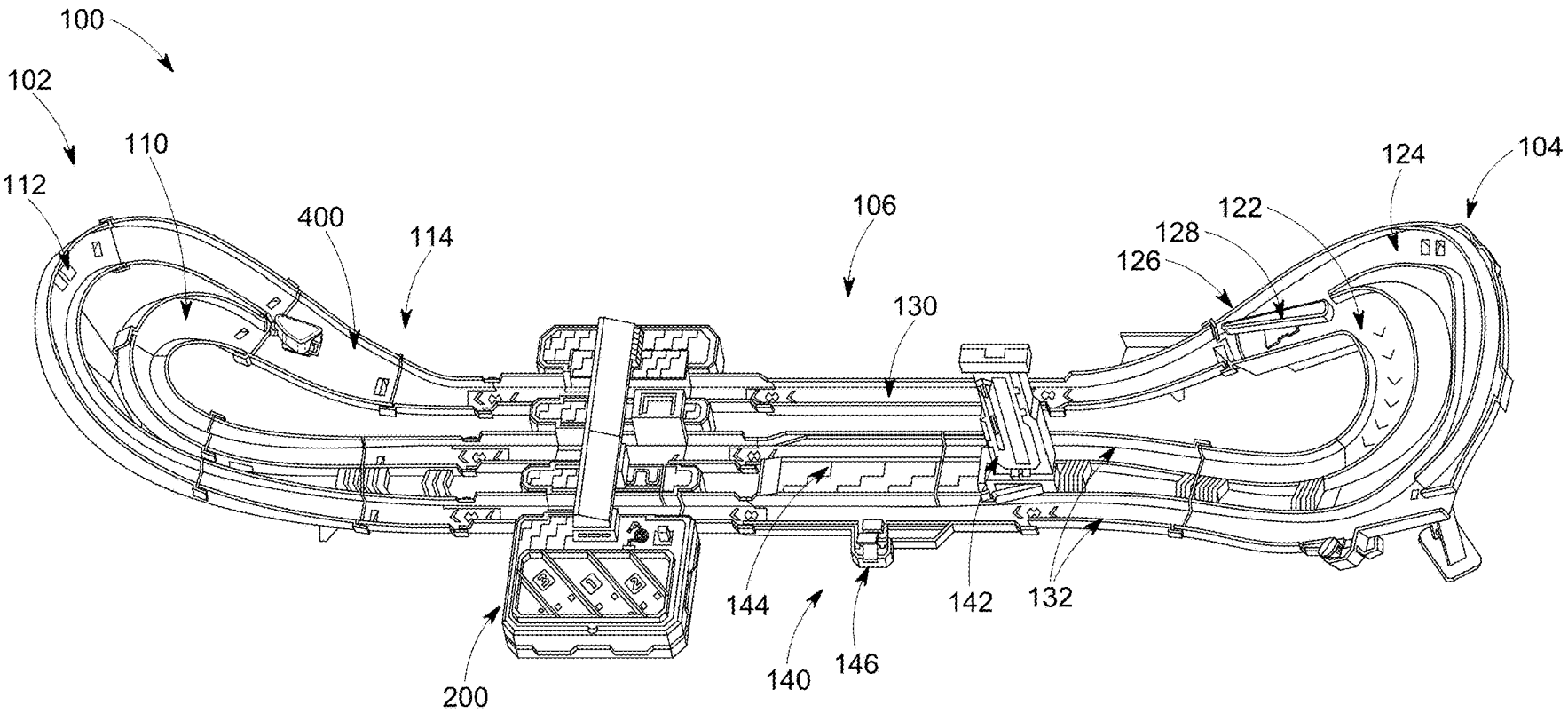
FIG. 1 illustrates a top perspective view of an example embodiment of a toy vehicle track configuration formed with the accessory track pieces of the present application.

First turning to FIG. 1, this figure depicts an example the track configuration 100 in which the accessory track pieces of the present application may be included. This track configuration 100 extends from a first end 102 to a second end 104, with a middle section 106 disposed between the first end 102 and the second end 104. Overall, this track configuration 100 is designed to encourage fast, continuous, and competitive racing between two or more toy vehicles. Thus, the first end 102 includes an inner turn lane 110 and an outer turn lane 112 that are each generally sized with widths that accommodate a single toy vehicle, but the first end 102 terminates in a second accessory track piece 400 that includes a convergent track piece. Thus, once a toy vehicle has entered the inner turn lane 110 or the outer turn lane 112, it may race a toy vehicle in the other of the inner turn lane 110 or the outer turn lane 112 to try to enter the convergent track path of the second accessory track piece 400 ahead of the other toy vehicle. Put another way, the second accessory track piece 400 generally defines an overtake area 114.

As is also detailed below, the first accessory track piece 200, which may also be referred to herein as a booster, includes two lanes that propel toy vehicles towards the first end 102 (e.g., into the inner turn lane 110 or the outer turn lane 112) in parallel. As is detailed below, the first accessory track piece 200 also includes another lane that propels toy vehicles towards the second end 104 in sequence. Thus, each toy vehicle traversing the track configuration 100 is boosted (i.e., propelled) along the track each time it enters the middle section 106, whether moving towards the first end 102 or the second end 104.

At the second end 104, the track configuration 100 includes an inner turn lane 122 and an outer turn lane 124; however, now, a user can divert toy vehicles into either lane as desired by manipulating a lane guide 128 included on a diverging track piece 126. Notably, the lane guide 128 is a static or fixed lane guide and simply guides a toy vehicle into one of inner turn lane 122 and outer turn lane 124 while fully blocking the other. By comparison, the second accessory track piece 400 includes a flexible diverter that allows vehicles to move along two paths of the second accessory track piece 400 in sequence, as is detailed below. After traversing inner turn lane 122 or outer turn lane 124, a toy vehicle returns to the middle section 106. While a single lane 130 extend from the first end 102 towards the second end 104, two lanes 132 extend from the second end 104 towards the first end 102. Thus, vehicles can, in some instances, race side-by-side towards the first accessory track piece 200 after exiting the second end 104. In fact, in some instances, the middle section 106 may include a starter piece 140 with a lap counter 142 that counts laps traversed by a toy vehicle. In some of these instances, the starter piece 140 may also include a tippable track section 144 and/or an actuator 146 that create an interesting manner of starting or re-starting a race. That all said, in some instances, the track configuration 100 may be reversible.

Figure 2:
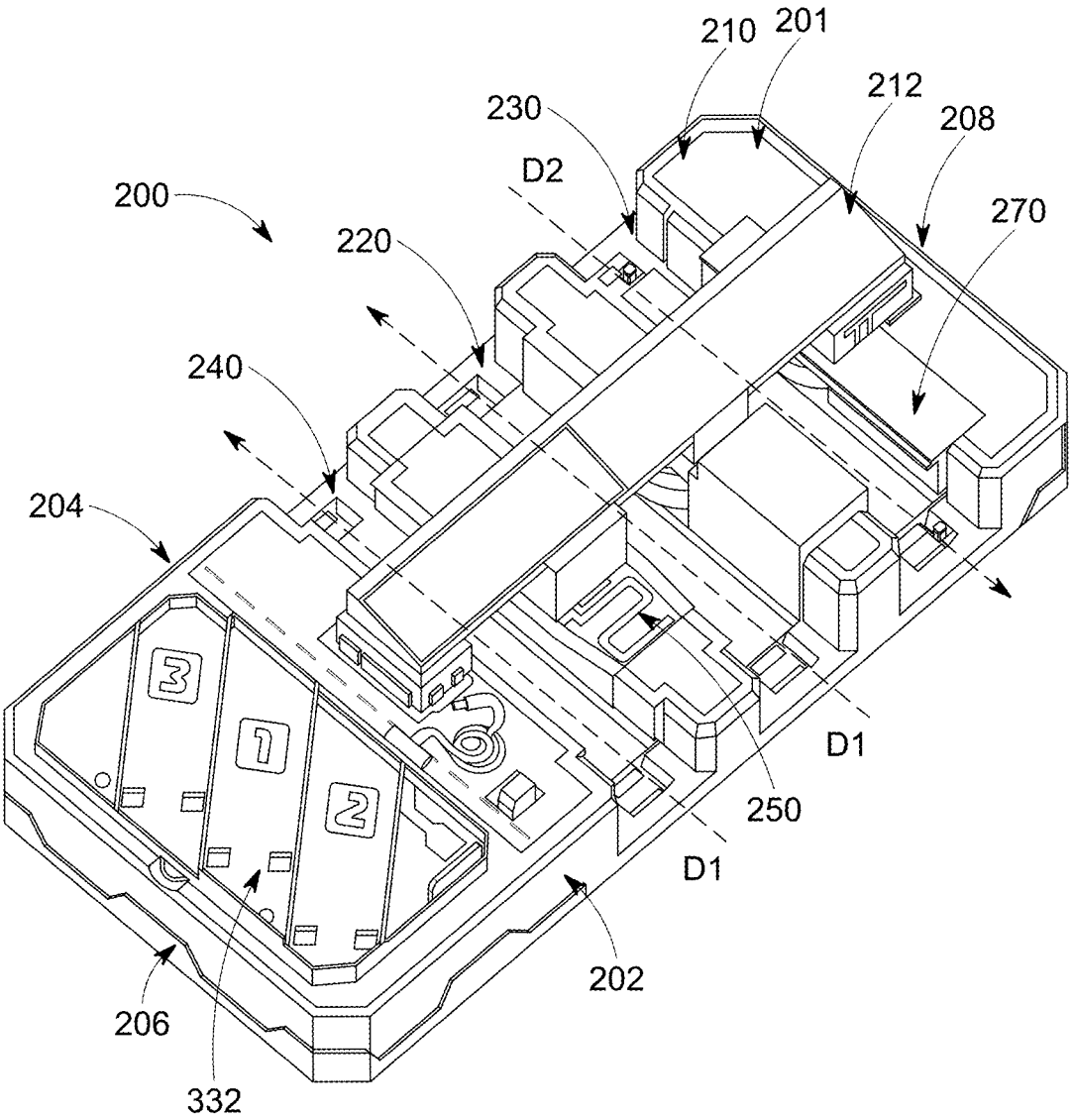
FIG. 2 illustrates a top perspective view of a first accessory track piece included in the toy vehicle configuration of FIG. 1; the first accessory track piece being formed in accordance with an example embodiment of the present application.
Figure 3:
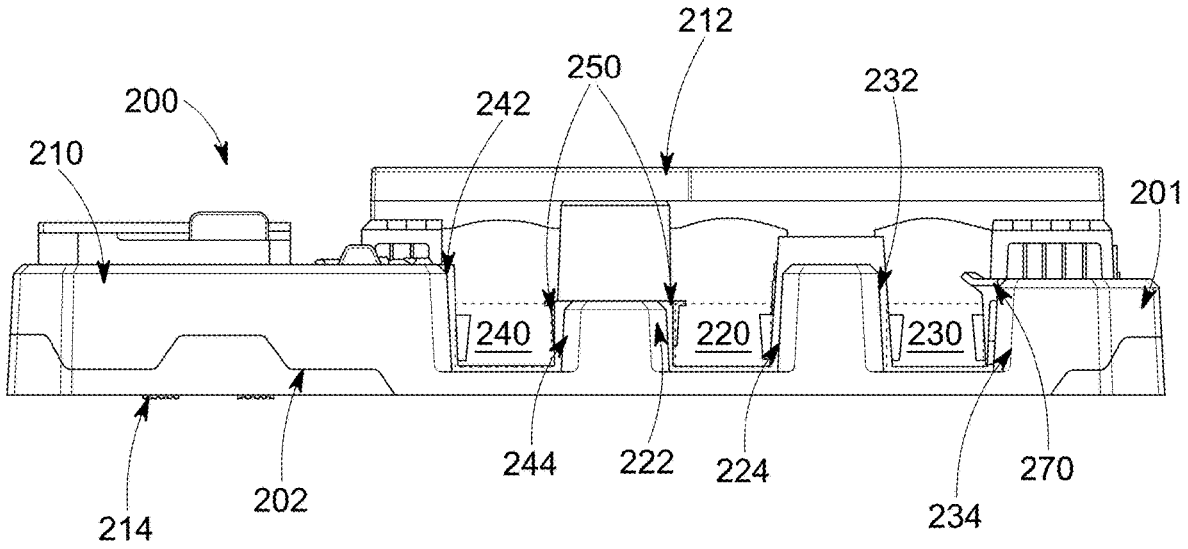
FIG. 3 illustrates a front view of the first accessory track piece of FIG. 2.
Figure 5:
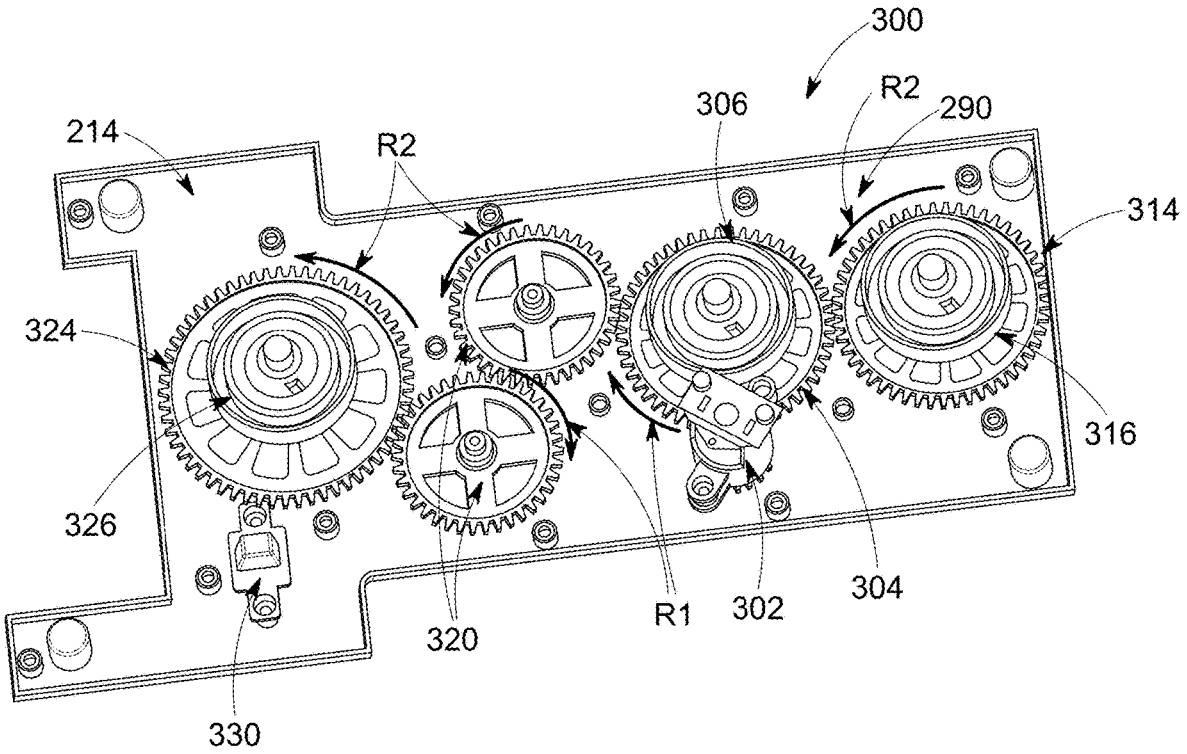
FIG. 5 illustrates a top view of a drive assembly included in the first accessory track piece of FIG. 2: the drive assembly being formed in accordance with an example embodiment of the present application.

Now turning to FIGS. 2 and 3, the first accessory track piece 200, or booster 200, of the present application is specifically designed to efficiently and effectively propel toy vehicles along a track configuration, such as track configuration 100, at high-speeds. Generally, the first accessory track piece 200 includes a base 201 that extends from a front 202 to a back 204 while also extending from a first side 206 to a second side 208. Additionally, in the depicted embodiment, the base 201 is generally formed by a top section 210 and a bottom section 214. The top section 210 and bottom section 214 define an interior cavity 290 (see FIG. 5) within which at least a drive assembly 300 (see FIG. 5) may be disposed. A power compartment 332 may also be defined at least partially within interior cavity 290. The power compartment 332 is generally denoted in FIG. 2 and may comprise any desired structural or power components that can power the drive assembly 300 and/or any other electrical components in first accessory track piece 200 via techniques now known or developed hereafter. For example, the power compartment 332 may have battery receptacles for single use or rechargeable batteries, may house a chargeable battery that is not removable from base 201, etc.

Regardless of the internal components included in first accessory track piece 200, multiple toy vehicle pathways extend through or along base 201, extending from the front 202 to the back 204. In the depicted embodiment, the first accessory track piece 200 includes three pathways, with a first pathway 220 is positioned between and substantially parallel to a second track pathway 230 and a third track pathway 240. The first pathway 220 and second track pathway 230 are configured to guide toy vehicles in a first direction D1 while the third track pathway 240 is configured to guide toy vehicles in a second direction D2, which is opposite to direction D1. In other embodiments, however, the first accessory track piece 200 might include a different number of pathways (e.g., two pathways or more than three) arranged in different manners and/or may be configured to guide toy vehicles in different directions than depicted. That is, other embodiments may also include a plurality of pathways, but may include more or less pathways for different directions than shown (e.g., two pathways or more than three).

Also, in the depicted embodiment, all of pathways 220, 230, and 240 may be covered by top covering 212. The top covering 212 may, in some embodiments, assist in forming the internal cavity of the base 201, e.g., to help support internal components of the first accessory track piece 200, such as the drive assembly 300. Alternatively, the top covering 212 may be formed separately. In any case, the top covering 212 may cover each of the first pathway 220, the second track pathway 230, and the third track pathway 240 and, thus, may help discourage a toy vehicle from vertically exiting one of the pathways 220, 230, 240 as the toy vehicle is boosted/propelled along one of the pathways 220, 230, 240. This may ensure toy vehicles to remain "grounded" (i.e., close to or on a track surface) during and subsequent to a boost/propulsion, or at least encourage such behavior.

It is important that toy vehicles remain grounded during a boost/propulsion along one of pathways 220, 230, 240 because each of the pathways 220, 230, 240 is intended to be coupled to additional track pieces. That is, after a boost/propulsion by first accessory track piece 200, a toy vehicle may "drive" along additional track pieces coupled to the first accessory track piece 200. To that end, the first pathway 220 is bounded by couplers 226, the second track pathway 230 is bounded by couplers 236 and the third track pathway 240 is bounded by couplers 246. Couplers 226, 236, and 246 are each configured to mate with corresponding couplers included on additional track pieces that, with the first accessory track piece 200, can form an open or closed track configuration, such as track configuration 100.

Figure 4:
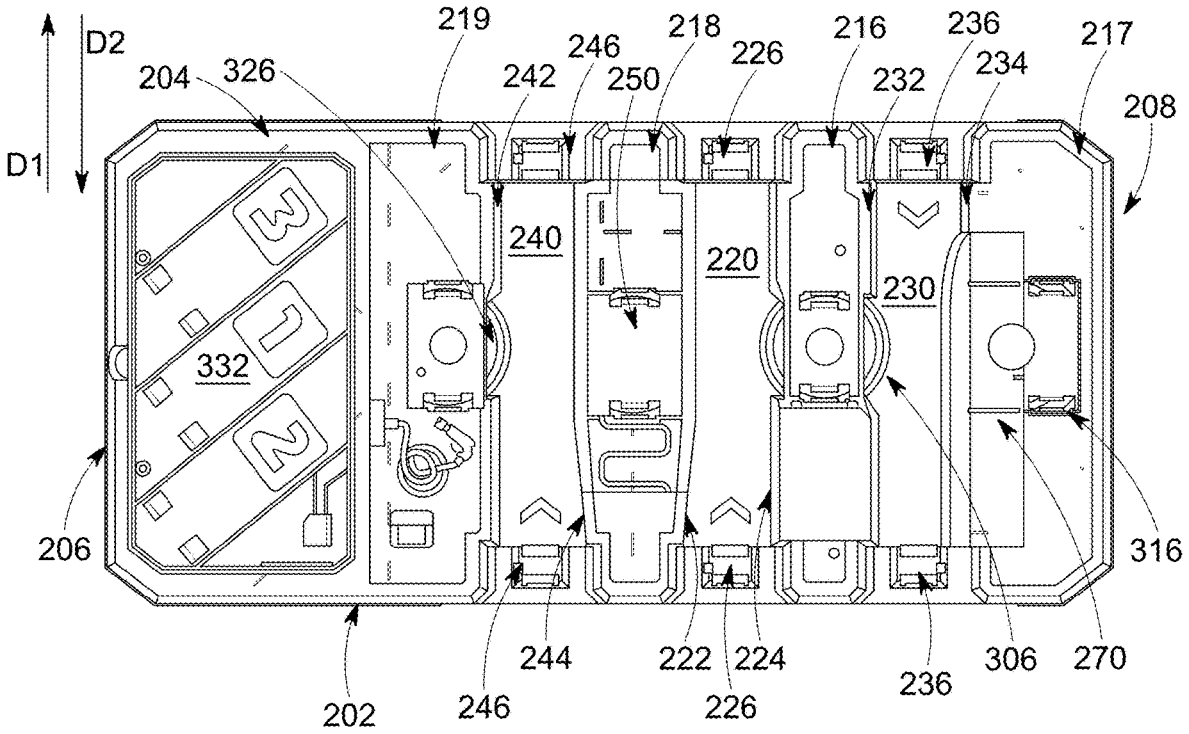
FIG. 4 illustrates a top view of the first accessory track piece of FIG. 2 with a top cover of the first accessory track piece removed.

FIG. 4 illustrates the first accessory track piece 200 without the top covering 212 to further illustrate the first pathway 220, the second track pathway 230, and the third track pathway 240. As can be seen in FIG. 4, and in FIG. 3 as well, the first pathway 220 is formed by a first lateral wall 222 defined in a top surface of the top section 210 and opposing, second lateral wall 224 defined in a top surface of the top section 210. The second lateral wall 224 is the internal wall of an inner raised structure 216 of the base 201 whose external wall defines an internal lateral wall 232 of the second track pathway 230. An exterior side of the second track pathway 230 is defined by an exterior lateral wall 234 defined in a top surface of an exterior raised structure 217 the top section 210 of the base 201. On the other side, the first lateral wall 222 is the internal wall of an interior raised structure 218 of the base 201 whose external wall defines an internal lateral wall 244 of the third track pathway 240. An exterior side of the third track pathway 240 is defined by an exterior lateral wall 242 defined in an exterior raised structure 219 of a top surface of the top section 210 of the base 201.

As can be seen in FIG. 4, the inner raised structure 216 generally houses a first booster wheel 306 that extends into both the first pathway 220 and the second track pathway 230. Thus, if the first booster wheel 306 is rotating in a clockwise direction, it can propel a toy vehicle moving along first pathway 220 in a first direction (e.g., direction D1)

while simultaneously or subsequently propelling a toy vehicle moving along second track pathway 230 in an opposite direction (e.g., direction D2). To be clear, however, the toy vehicle propelled in the opposite direction may be the same toy vehicle circling back to the first accessory track piece 200 and/or an additional toy vehicle.

The exterior raised structure 217 generally houses a second booster wheel 316 that is configured to extend into the second track pathway 230. The second booster wheel 316 is generally configured to work with the first booster wheel 306 to boost a toy vehicle. Thus, for example, the second booster wheel 316 may be configured to engage and propel/boost a toy vehicle moving along second track pathway 230 in the same direction as first booster wheel 306. As a specific example, the first booster wheel 306 may rotate in a clockwise direction while second booster wheel 316 may rotate in a counter-clockwise direction so that the first booster wheel 306 and the second booster wheel 316 collectively boost a toy vehicle in direction D2.

Next, the exterior raised structure 217 generally houses a third booster wheel 326 that is configured to extend into the third track pathway 240. In the depicted embodiment, the third booster wheel 326 is the only booster wheel extending into the third track pathway 240 and, thus, the third booster wheel 326 need not work in unison with another booster wheel. This arrangement is also used in first pathway 220, into which only the first booster wheel 306 extends. With these single-booster pathways, however, a toy vehicle may tend to tip, tilt, veer, or otherwise move in a skewed manner as a booster wheel engages one side of the toy vehicle without another booster wheel contacting the opposite side of the toy vehicle.

To compensate for this issue, the interior raised structure 218 between the first pathway 220 and the third track pathway 240 includes a first track guide 250. Moreover, in the depicted embodiment, even though the second track pathway 230 has booster wheels 306 and 316 configured to engage opposite side of a toy vehicle, the exterior raised structure 217 also includes a second track guide 270. The inventors have found that first track guide 250 and second track guide 270 help encourage toy vehicles to remain on a toy vehicle track when boosted at high speeds. The first track guide 250 and the second track guide 270 are each described in turn below.

Before turning to first track guide 250 and second track guide 270, however, it is important to understand how the booster wheels of the first accessory track piece 200 operate. Thus, an example embodiment of the drive assembly 300 of the first accessory track piece 200 is now described with respect to FIG. 5. As can be seen, in the depicted embodiment, the drive assembly 300 includes a motor 302 configured to directly engage a first drive gear 304 that is mounted to and configured to rotate with the first booster wheel 306. In turn, the first drive gear 304 is configured to engage a second drive gear 314 that is mounted to and configured to rotate with the second booster wheel 316. Thus, if the motor 302 rotates the first booster wheel 306 in a first rotational direction R1 via first drive gear 304, the first drive gear 304 will drive the second drive gear 314 and second booster wheel 316 in a second rotational direction R2 that is opposite to the first rotational direction R1. That is, the first booster wheel 306 and the second booster wheel 316 are linked booster wheels driven by a single motive source.

At the same time, the first drive gear 304 is also coupled, via two linkage gears 320, to a third drive gear 324, which is mounted to and configured to rotate with the third booster wheel 326. The two linkage gears 320 are arranged to cause the third drive gear 324 and the third booster wheel 326 to rotate in the second rotational direction R2. Thus, the first booster wheel 306 and the third booster wheel 316 are also linked booster wheels driven by a single motive source.

In the depicted embodiment, the third booster wheel 326 needs to rotate in an opposite rotational direction than the first booster wheel 306 to propel toy vehicles in the same direction. This is because the third booster wheel 326 and first booster wheel 306 are positioned on different sides of their respective pathways. Similarly, in the depicted embodiment, the second booster wheel 316 needs to rotate in an opposite rotational direction than the first booster wheel 306 so that these two booster wheels can work together to collectively propel toy vehicles. In other embodiments, however, different linkages can be used to cause any booster wheels to rotate in any desired directions.

Critically, with the first accessory track piece 200 of the present application, three booster wheels can be driven by a single motor 302 to boost toy vehicles along three separate and distinct pathways (e.g., pathways 220, 230, and 240). In fact, in some instances, the first booster wheel 306 and the third booster wheel 326 can work without the second booster wheel 316 to boost toy vehicles along three separate and distinct pathways. By comparison, known multi-lane boosters often include two booster wheels per pathway/lane and/or include multiple motors. Thus, the first accessory track piece 200 presents significant cost minimization and reduced complexity (which in turn, can reduce technical issues or malfunctions).

In the depicted embodiment, all three can be activated/deactivated via a switch 330; however, in other embodiments, other activation methods can be utilized. As mentioned, the efficiencies of the drive assembly 300 can be achieved, at least in part, because of first track guide 250 and second track guide 270. Regardless of how the booster wheels 306, 316, and 326 are operated/activated, each booster wheel can propel a toy vehicle by compressing against a side of the toy vehicle to impart a rotational, propelling force to the toy vehicle in manners now known or developed hereafter.

Figure 6:
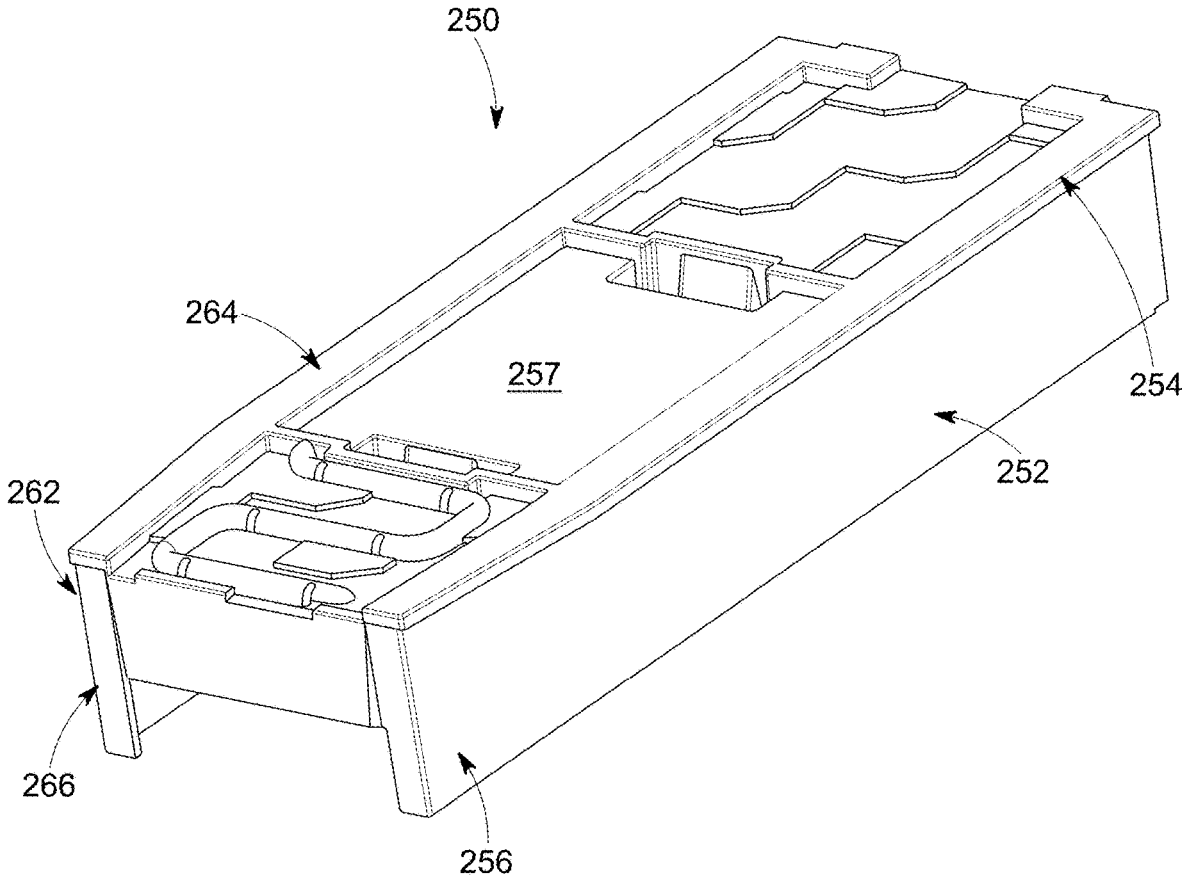
FIGS. 6-8 illustrate a top perspective view, a rear view, and a front view, of a first track guide included in the in the first accessory track piece of FIG. 2, the first track guide being formed in accordance with an example embodiment of the present application.
Figure 7:
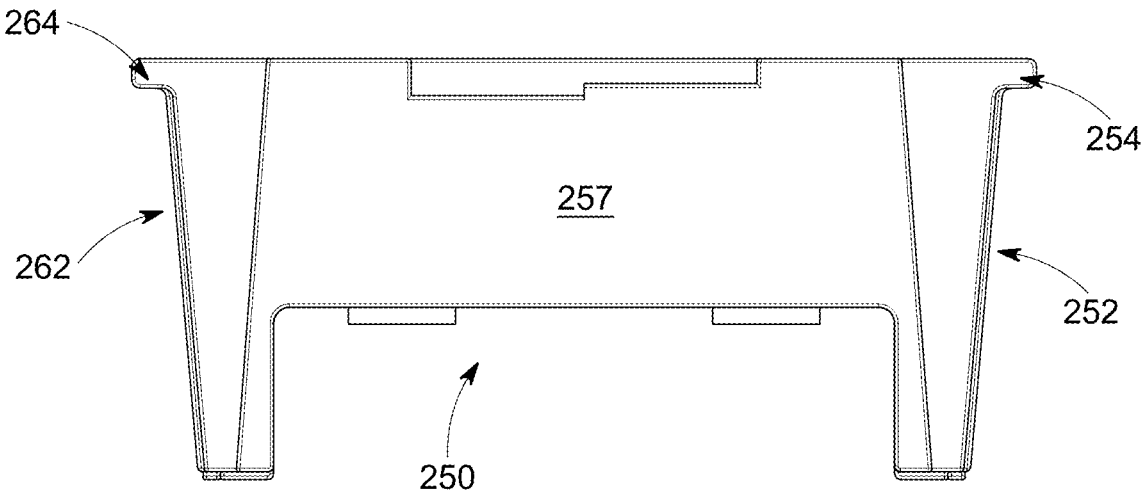
Figure 8:
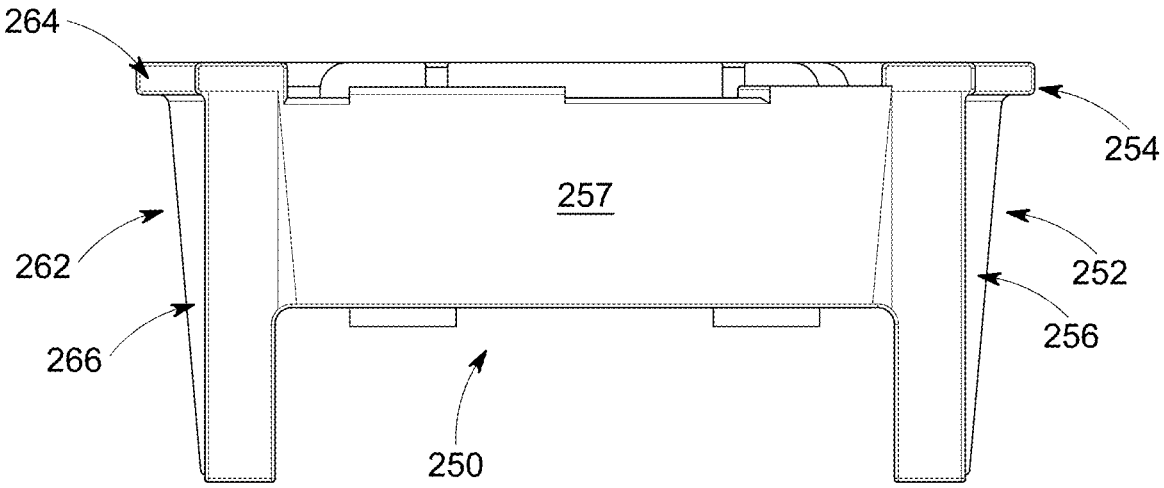
Figure 9:
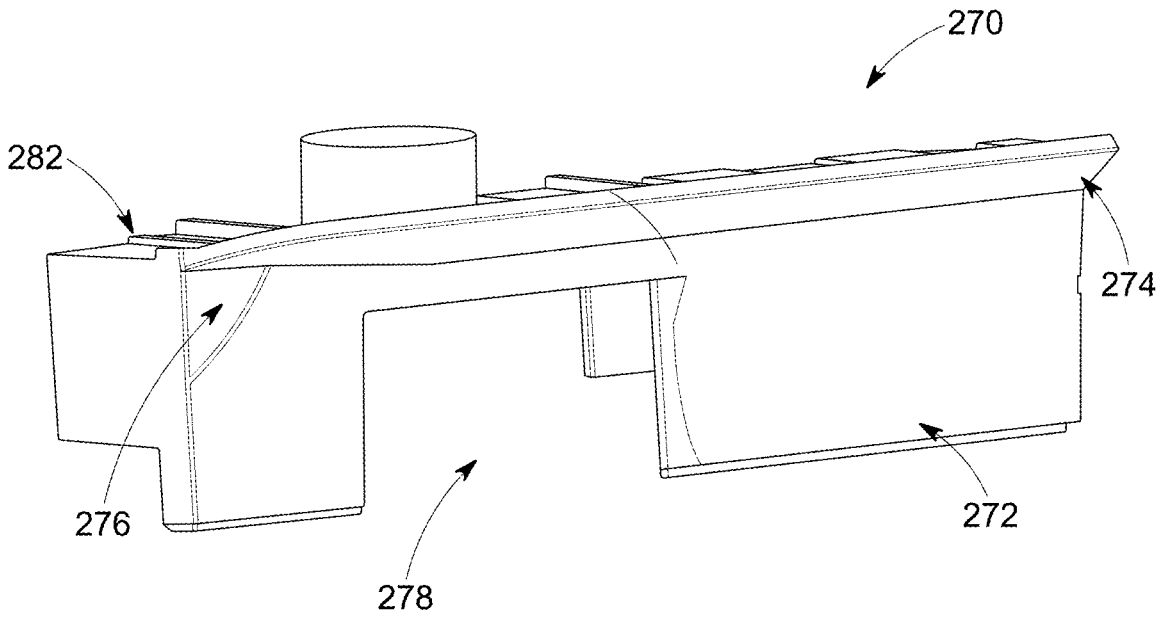
FIGS. 9-12 illustrate an interior perspective view, an exterior perspective view, a rear view, and a front view, respectively, of a second track guide included in the in the first accessory track piece of FIG. 2, the second track guide being formed in accordance with an example embodiment of the present application.
Figure 10:
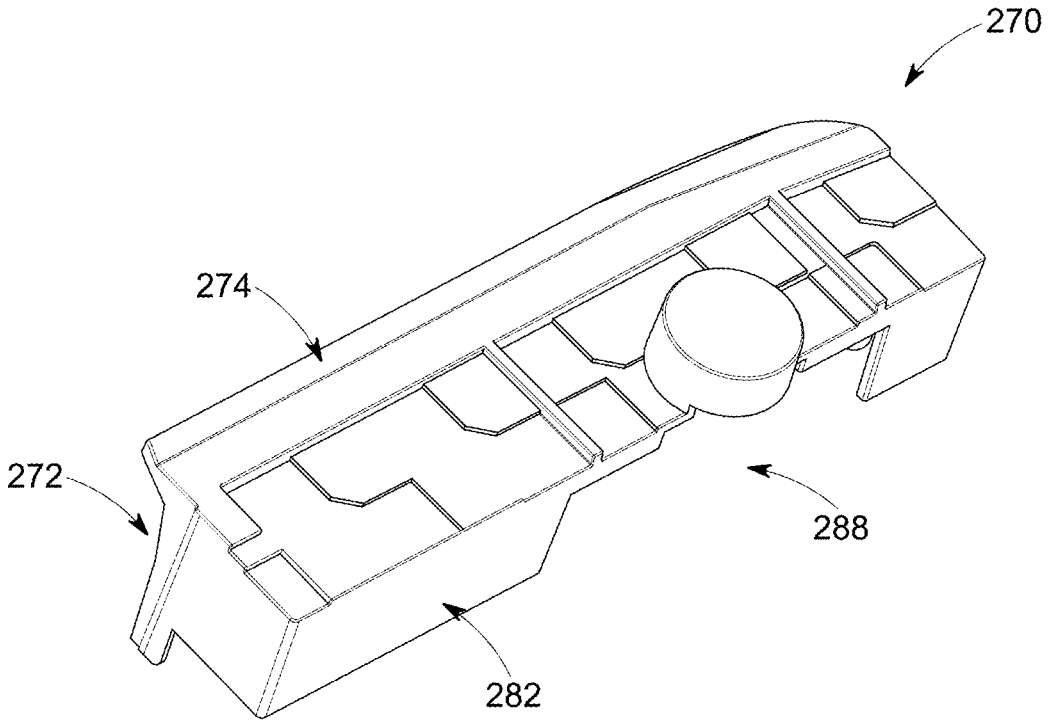
Figure 11:
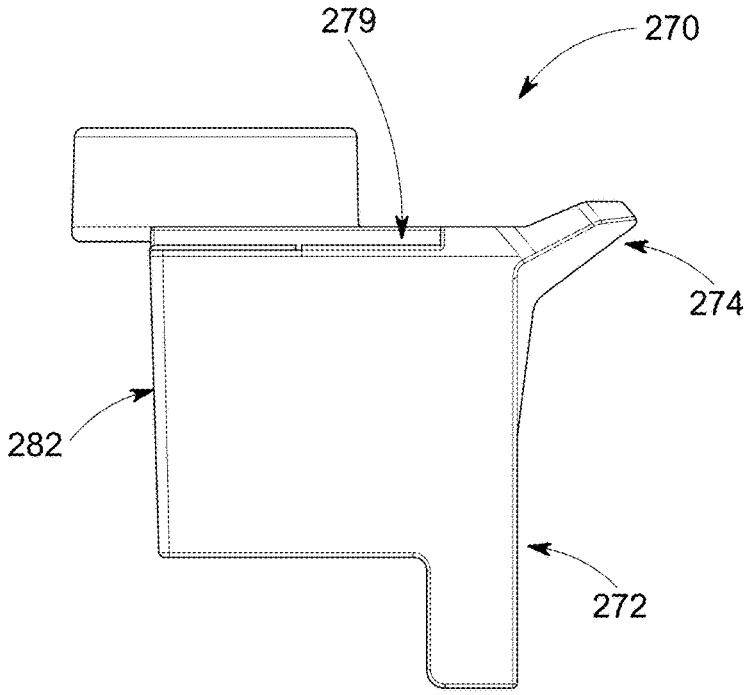
Figure 12:
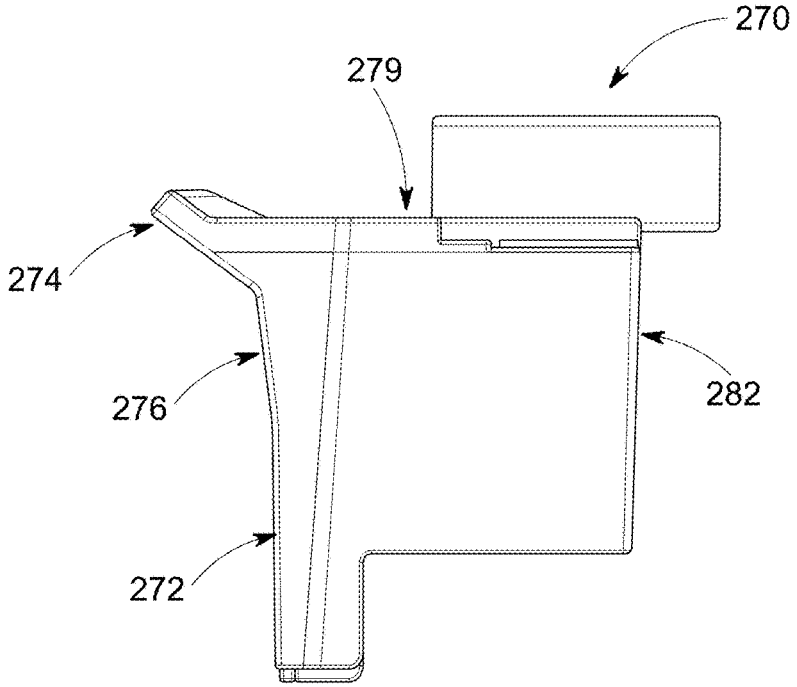

Now turning to FIGS. 6-8, in the present application, the first track guide 250 is configured to engage and retain toy vehicles moving along pathways that include a single booster wheel on one side thereof (e.g., first pathway 220 and third track pathway 240 of the depicted embodiment). The first track guide 250 is generally positioned opposite the booster when (with the pathway between the booster wheel and the first track guide 250) and includes lateral walls and overhangs that prevent, or at least discourage a toy vehicle from tilting or tipping while engaged by the single, side booster wheel. At a minimum, the lateral walls and overhangs that prevent, or at least discourage a toy vehicle from ejecting from the track.

More specifically, the first track guide 250 includes a first lateral wall 252 and an opposite second lateral wall 262 separated by central section 257. The first lateral wall 252 and the second lateral wall 262 can each serve as bases against which toy vehicles can be compressed when engaged by a booster wheel. Additionally, a top edge of lateral wall 252 includes an overhang 254 and a top edge of second lateral wall 262 includes an overhang 264. Overhangs 254 and 264 are configured to extend above at least a portion of a toy vehicle and, thus, prevent or at least discourage a toy vehicle from tipping upwards while traversing a pathway through the first accessory track piece 200. Finally, in the depicted embodiment, the first lateral wall 252 and second lateral wall 262 include tapered section 256 and tapered section 266, respectively. These tapers narrow the pathway towards the booster to help smoothly guide a toy vehicle into contact with a single, side booster wheel.

Next, and now turning to FIGS. 9-12, the second track guide 270 includes similar features to the first track guide 250, but it is included around a booster wheel (while first track guide 250 is included on an interior raised structure 218 that does not house a booster wheel). More specifically, the second track guide 270 includes an inner lateral wall 272 with an overhang 274 and a tapered section 276 that are configured to function in a similar manner to the overhangs and tapers of first track guide 250. Additionally, the second track guide 270 includes an interior booster opening 278 in its inner lateral wall 272 and an exterior booster opening 288 in its second lateral wall 282, which is coupled to the inner lateral wall 272 via a central section 279. Collectively, interior booster opening 278 and exterior booster opening 288 allow an overhang wall to be positioned over a booster, which helps retain a toy vehicle on the track even when a pathway has boosters on both sides.

Figure 13:
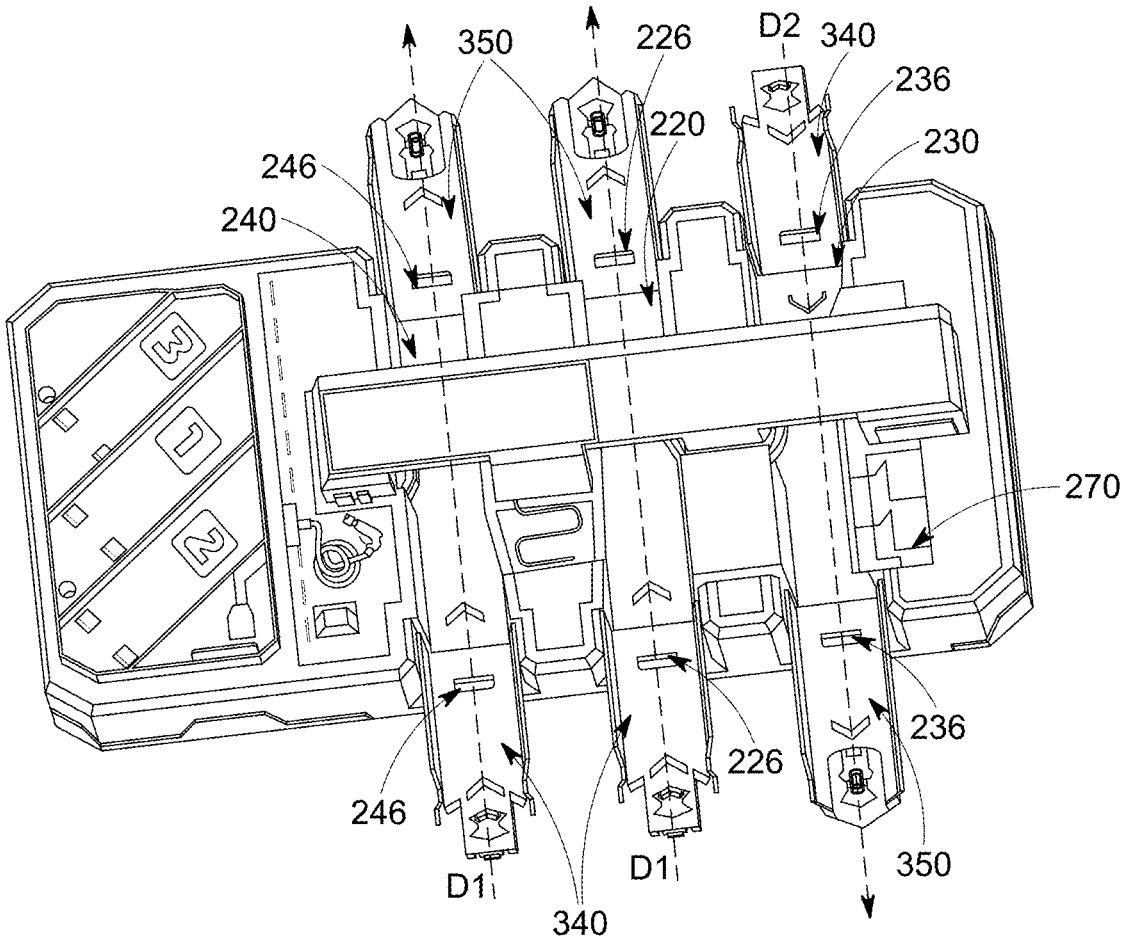
FIG. 13 illustrates a top view of the first accessory track piece of FIG. 2 with three pairs of toy vehicle track pieces connected thereto, each pair including an entry track piece and an exit track piece formed in accordance with an example embodiment of the present application.

Turning next to FIGS. 13-17, when a toy vehicle is boosted at high speed by first accessory track piece 200, the first track guide 250 and second track guide 270 may help retain the toy vehicle on a track pathway, but the toy vehicle may still experience some tilt or tipping. Thus, in at least some embodiments, the first accessory track piece 200 may include specialized entrance and exit track pieces that guide toy vehicles into and out of first pathway 220, second track pathway 230, and third track pathway 240. FIG. 13 depicts example entry track pieces 340 and example exit track pieces 350 coupled to couplers 226, 236, and 246 of first pathway 220, second pathway 230, and third pathway 240, respectively.

More specifically, entry track pieces 340 are coupled to the first pathway 220 and the third track pathway 240 adjacent the front 202 of the first accessory track piece 200 while an entry track piece 340 is coupled to the second track pathway 230 adjacent the back 204 of the first accessory track piece 200. Meanwhile, exit track pieces 350 are coupled to the first pathway 220 and the third track pathway 240 adjacent the back 204 of the first accessory track piece 200 while an exit track piece 350 is coupled to the second track pathway 230 adjacent the front 202 of the first accessory track piece 200.

Figure 14:
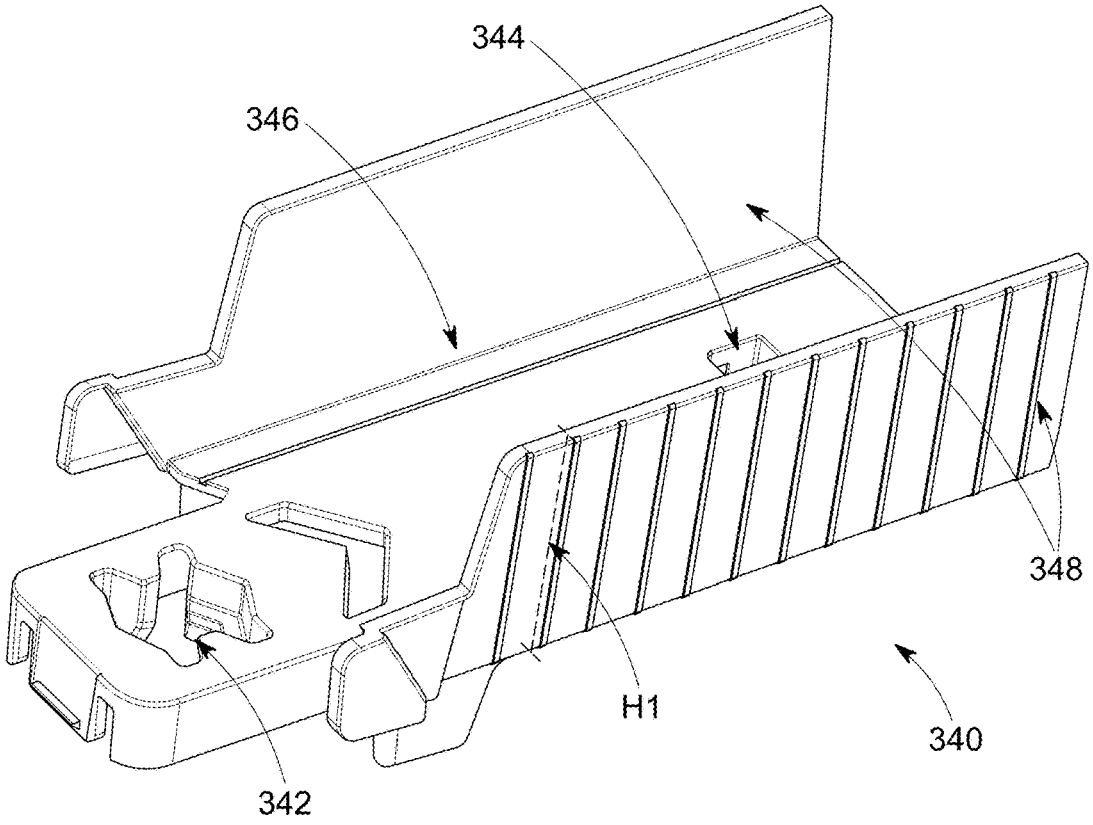
FIGS. 14 and 15 illustrate a top perspective view and a rear view, respectively, of one of the entry track pieces of FIG. 13.
Figure 15:
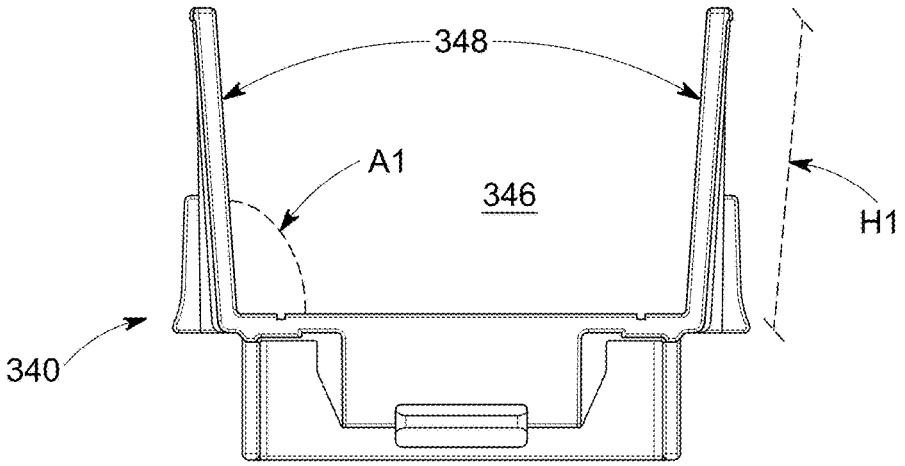

As can be seen in FIGS. 14 and 15, the entry track pieces 340 each extend from a proximal end with an accessory coupler 344 to a distal end with a track piece coupler 342. The accessory coupler 344 is configured to mate with one of the couplers 226, 236, 246 on the first accessory track piece 200 while the track piece coupler 342 is configured to mate with additional track pieces of a track configuration. Opposing sidewalls 348 generally extend between the accessory coupler 344 and the track piece coupler 342 to define a pathway 346 therebetween. These opposing sidewalls 348 have an increased height H1 that is configured to guide toy vehicles into a first accessory track piece 200. Additionally, in the depicted embodiment, the opposing sidewalls 348 are angled away from each other, at an angle A1 with respect to a base of the pathway 346, to help accommodate a variety of vehicles.

Figure 16:
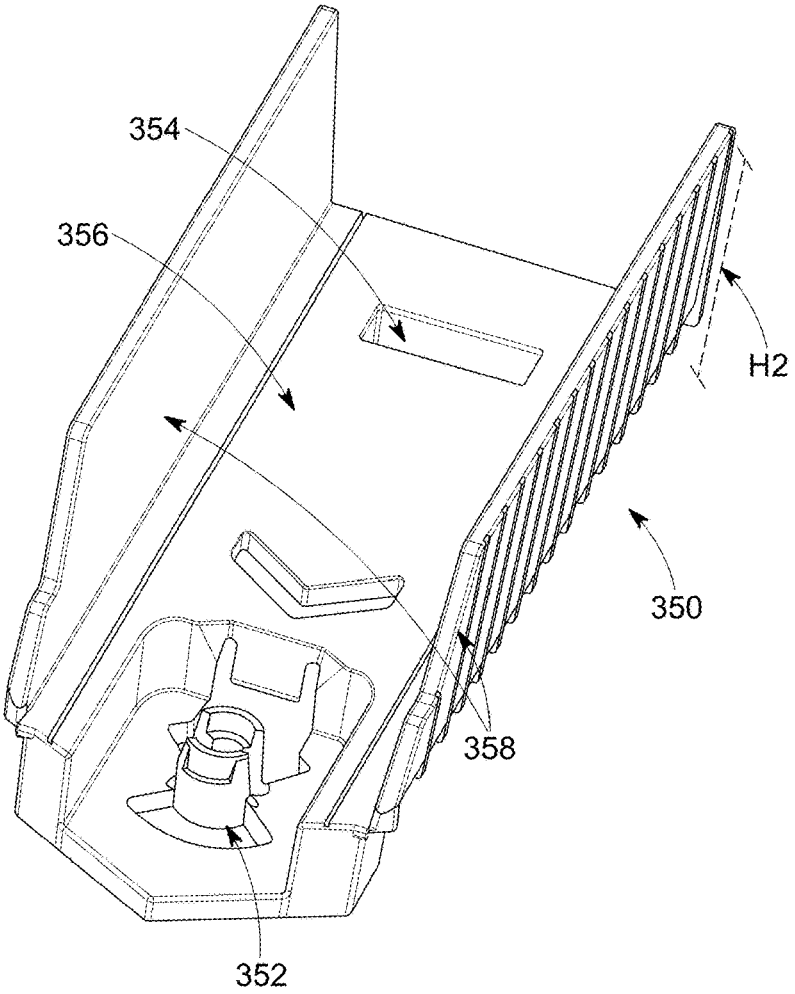
FIGS. 16 and 17 illustrate a top perspective view and a rear view, respectively, of one of the entry track pieces of FIG. 13.
Figure 17:
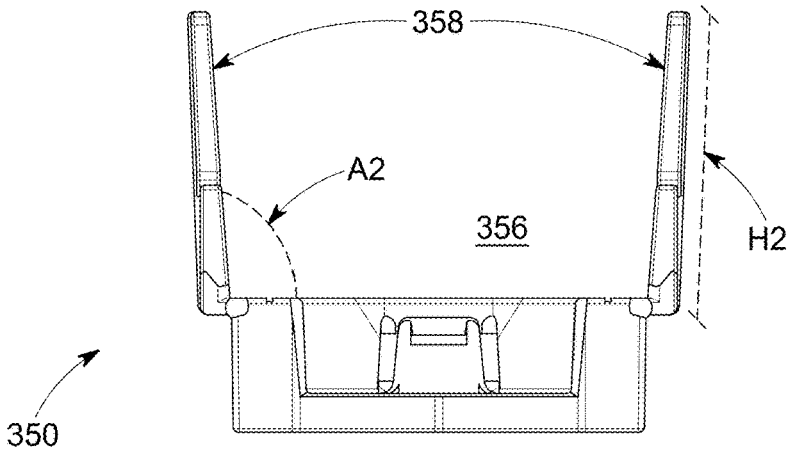

The exit track piece 350, which is depicted in FIGS. 16 and 17, is substantially similar to the entry track piece 340. For example, each of the exit track pieces 350 extend from a proximal end with an accessory coupler 354 to a distal end with a track piece coupler 352. The accessory coupler 354 is configured to mate with one of the couplers 226, 236, 246 on the first accessory track piece 200 while the track piece coupler 352 is configured to mate with additional track pieces of a track configuration. Furthermore, opposing sidewalls 358 generally extend between the accessory coupler 354 and the track piece coupler 352 to define a pathway 356 therebetween. These opposing sidewalls 358 have an increased height H2 that is configured to receive and retain toy vehicles boosted/propelled from a booster first accessory track piece 200. Since the first accessory track piece 200 may impart a tilt, tip, or other such movement to a toy vehicle, these opposing sidewalls 358 are critically important to preventing a toy vehicle from exiting a track set after being boosted/propelled. Additionally, in the depicted embodiment, the opposing sidewalls 358 are angled away from each other, at an angle A2 with respect to a base of the pathway 356, to help accommodate a variety of vehicles. Angle A2 may be the same or different than angle A1 and height H2 may be the same or different than height H1.

Figure 18:
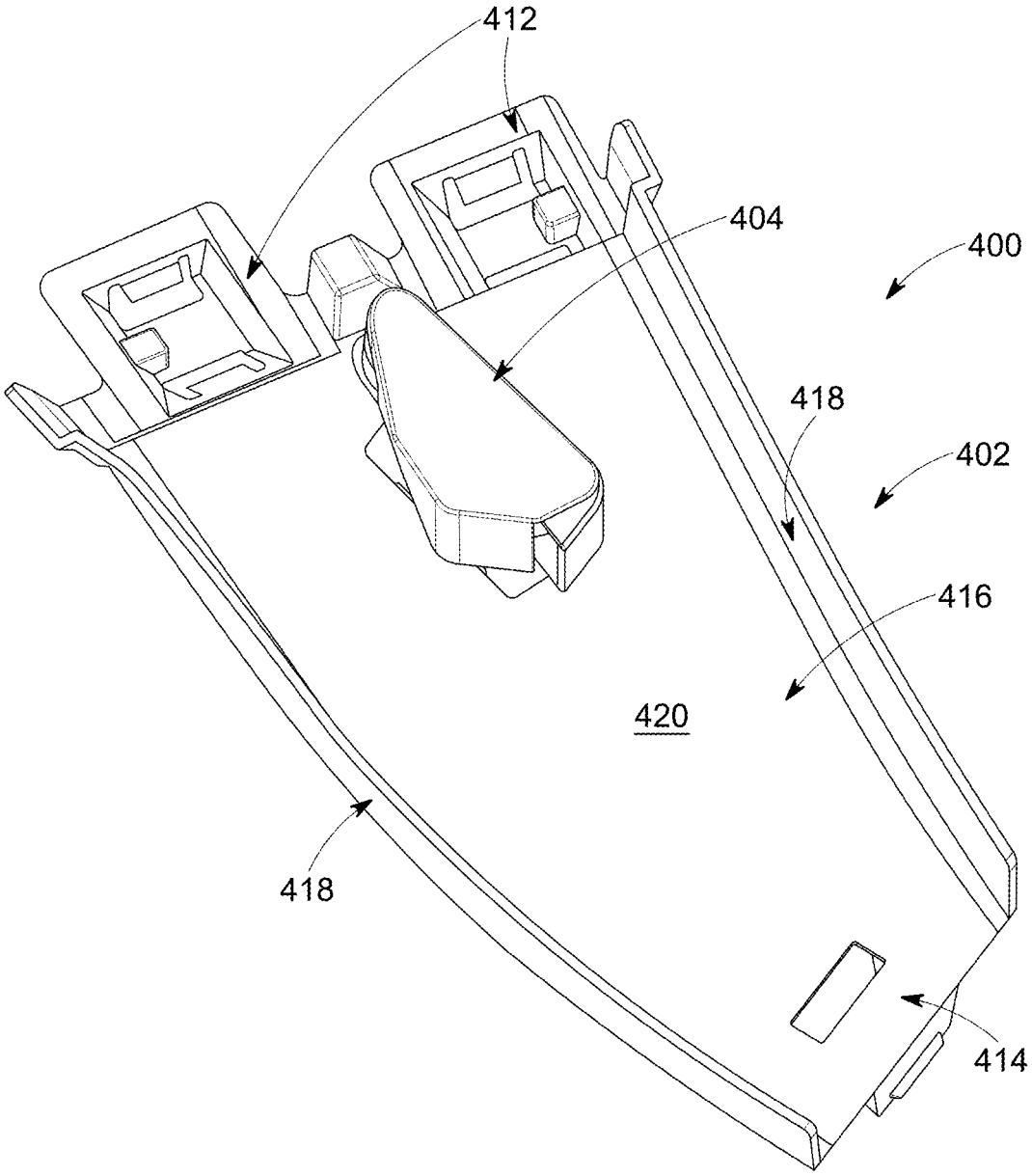
FIG. 18 illustrates a top perspective view of a second accessory track piece included in the toy vehicle configuration of FIG. 1; the second accessory track piece being formed in accordance with an example embodiment of the present application.

Now turning to FIG. 18, the track configuration 100 of FIG. 1 also includes a second accessory track piece 400. The second accessory track piece 400 also helps ensure that high speed vehicles can continuously traverse a high-speed track configuration without exiting or ejecting from the track. To that end, the second accessory track piece 400 includes a convergent trackway 402 and a flexible diverter 404. Generally, the flexible diverter 404 helps retain a second/slower/latter toy vehicle on the convergent trackway 402 even when a faster/first toy vehicle causes the flexible diverter 404 to move to block the pathway of the second second/slower/latter toy vehicle. Put another way, the convergent trackway 402 is generally configured to allow two toy vehicles to enter in parallel while forcing the two toy vehicles to exit in sequence/series, but the flexible diverter 404 encourages both vehicles to remain on the convergent trackway 402 during this process. By comparison, stiff/static diverters can often impart a jolting or jarring force to a toy vehicle that causes the toy vehicles to jump or otherwise exit a convergent track.

In the depicted embodiment, the convergent trackway 402 extends from a first end with twin couplers 412 to a second, opposite end with a single coupler 414. Each coupler generally defines a lane (e.g., a toy vehicle car width) and, thus, a pathway 416 of the convergent trackway 402 generally converge from two lanes to one. The lanes are not divided beyond the flexible diverter 404, however, and instead, the convergent pathway is bounded by opposing walls 418 at lateral edges of the convergent trackway 402. The opposing walls 418 extend upwards from a bottom surface 420 that, in the depicted embodiment, includes a cavity 421 configured to receive a base piece or mounting portion of the flexible diverter 404.

Figure 19:
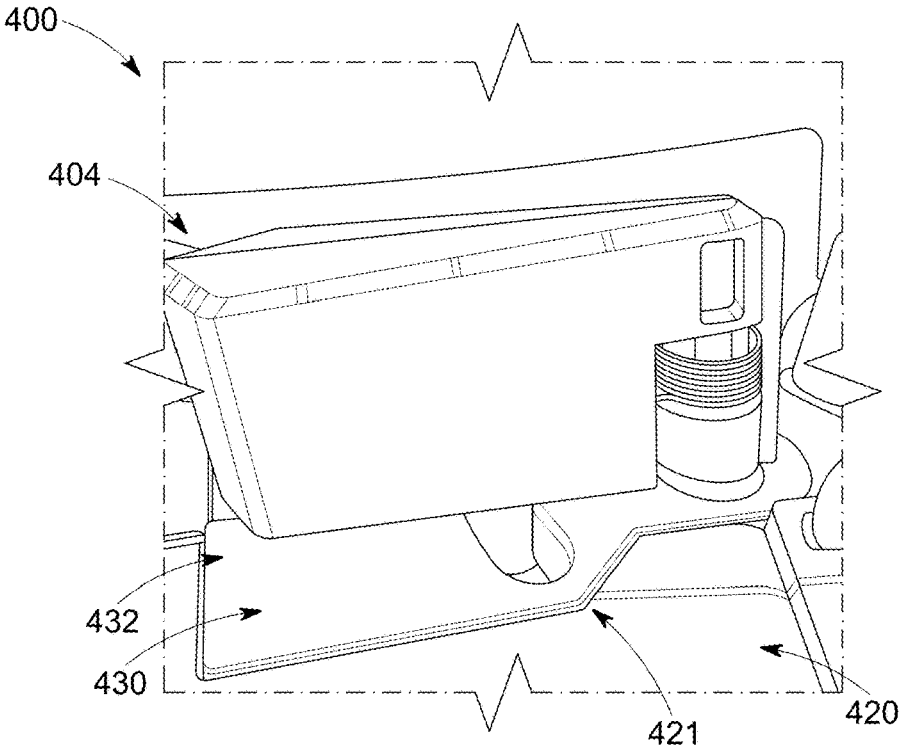
FIG. 19 illustrates a side view of a flexible diverter included in the second accessory track piece of FIG. 18: the flexible diverter being formed in accordance with an example embodiment of the present application.
Figure 20:
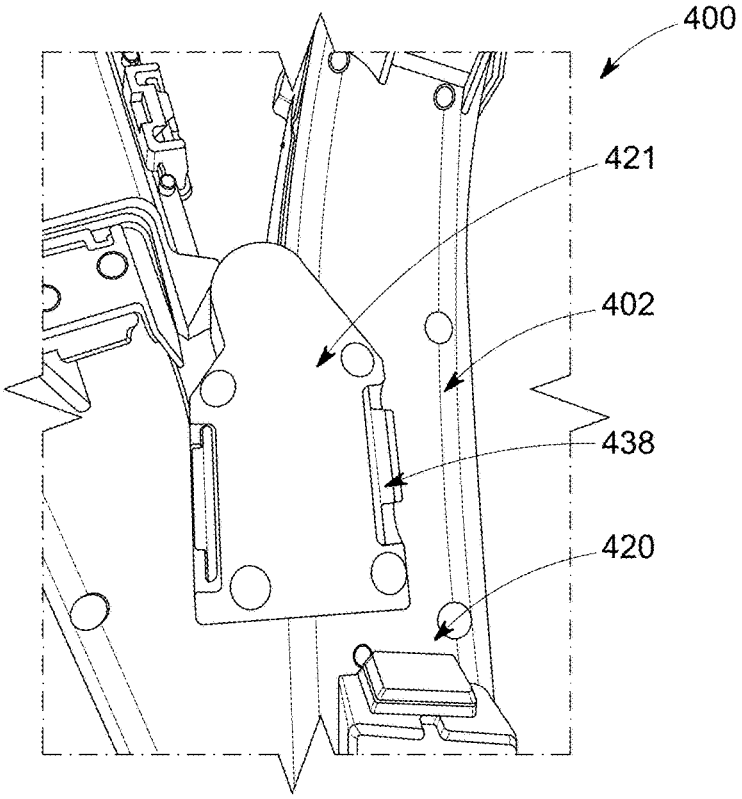
FIG. 20 illustrates a bottom perspective view of a portion of the second accessory track piece of FIG. 18.
Figure 21:
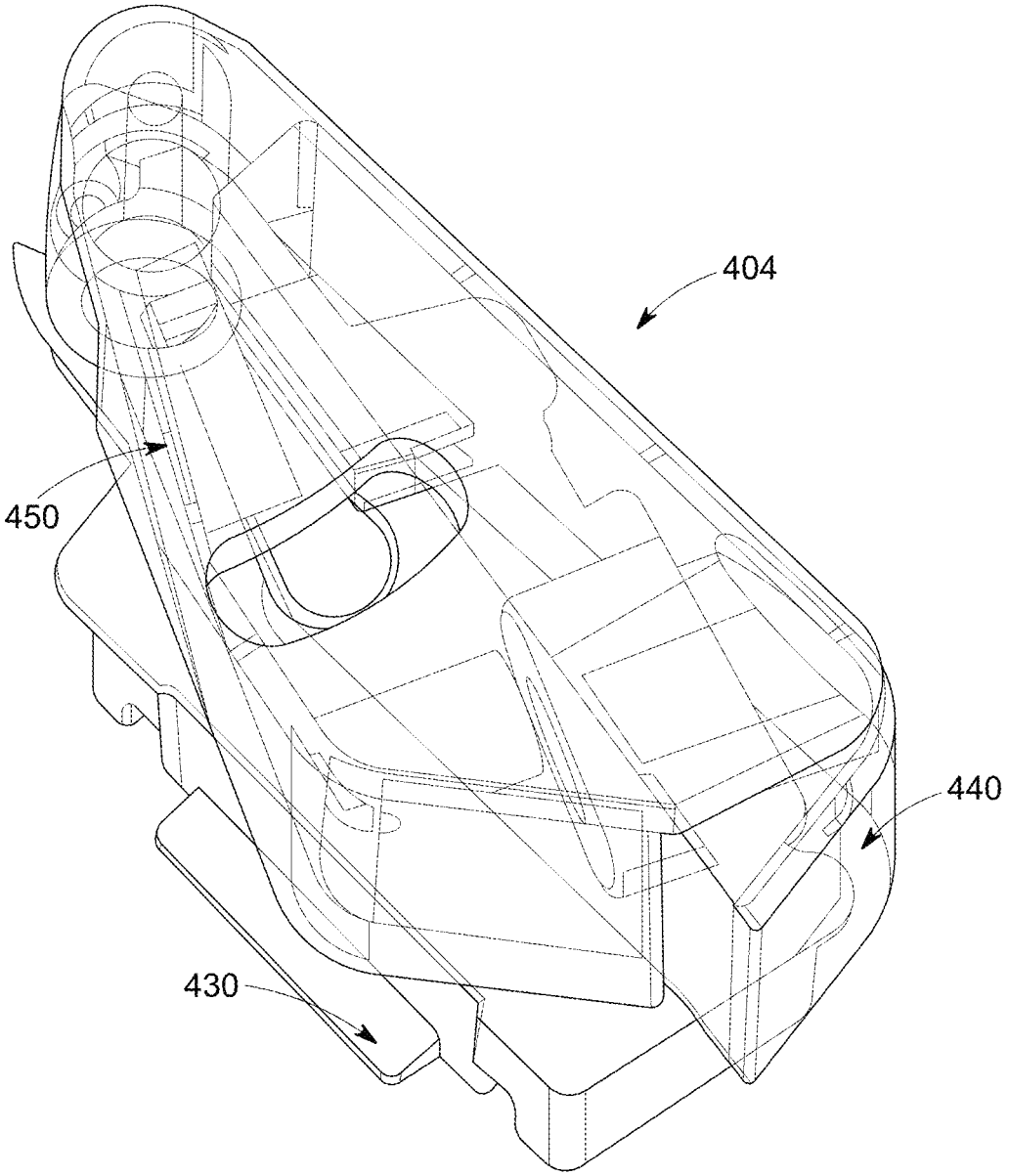
FIG. 21 illustrates a top perspective view of the flexible diverter of FIG. 19 removed from the track pathway of the second accessory track piece, with a portion of the flexible diverter being illustrated as transparent.
Figure 22:
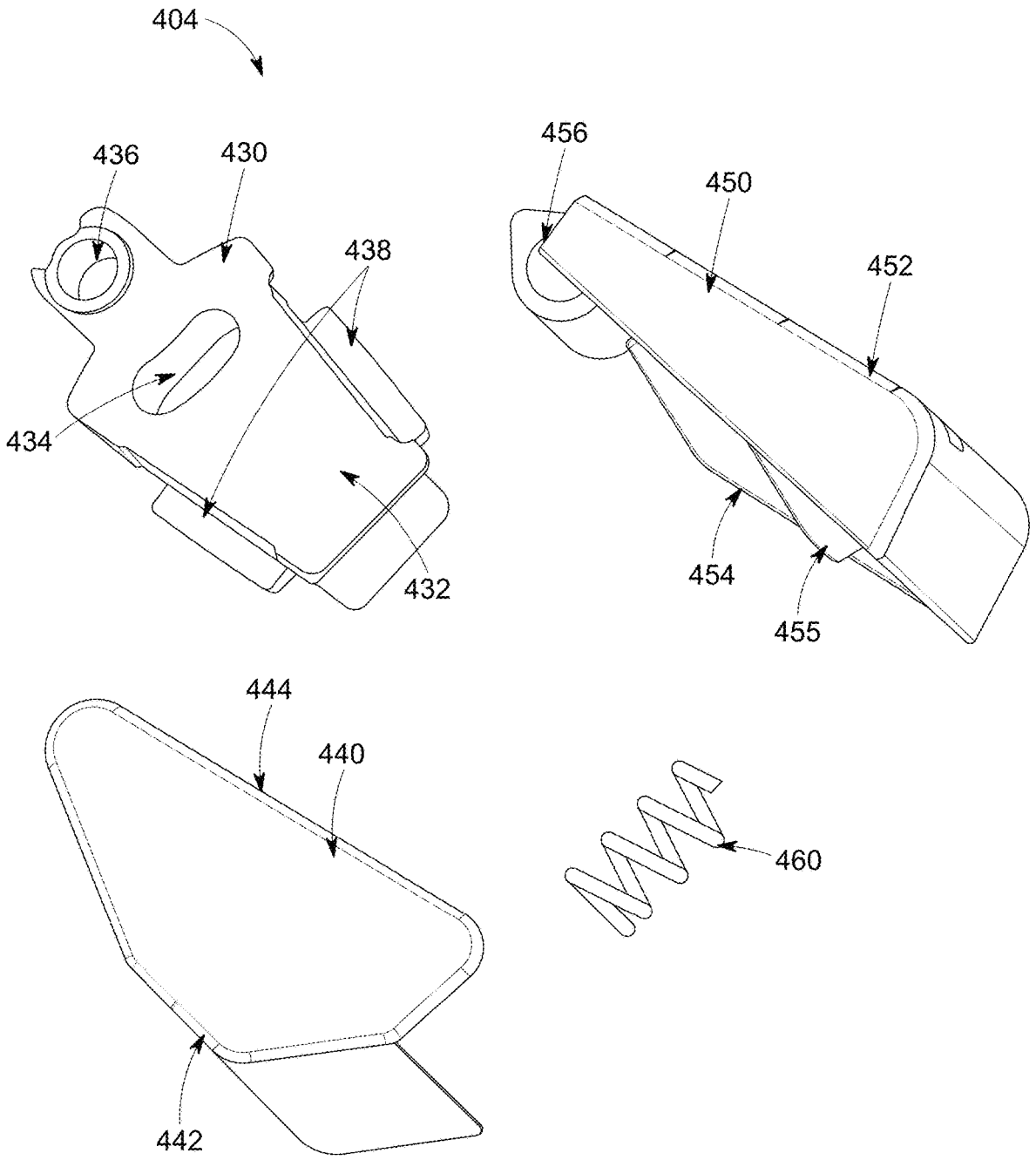
FIG. 22 illustrates an exploded, top perspective view of the flexible diverter of FIG. 19.
Figure 23:
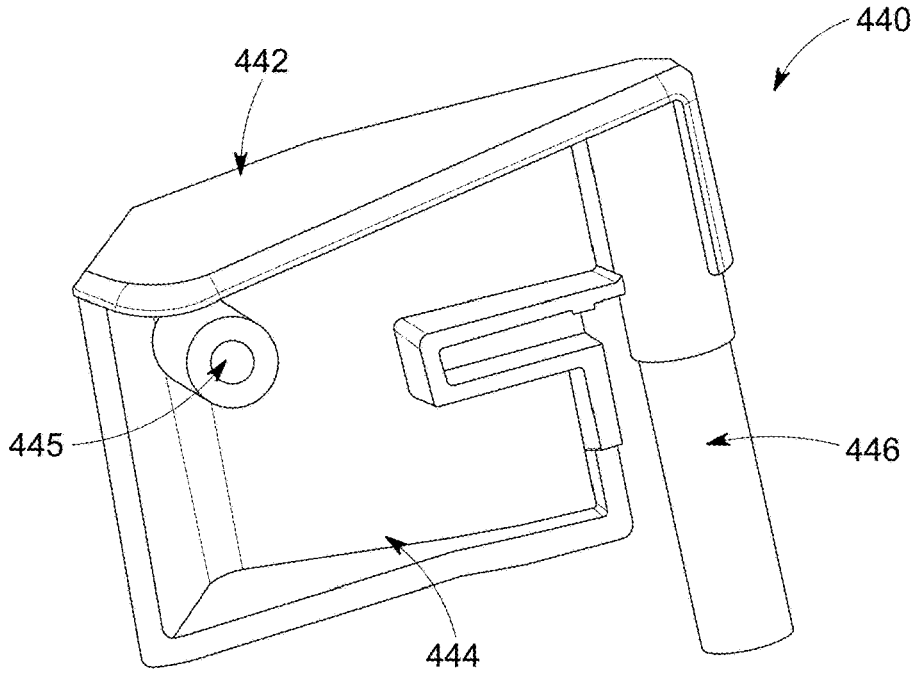
FIGS. 23 and 24 illustrate side view of pieces of the flexible diverter of FIG. 19.
Figure 24:
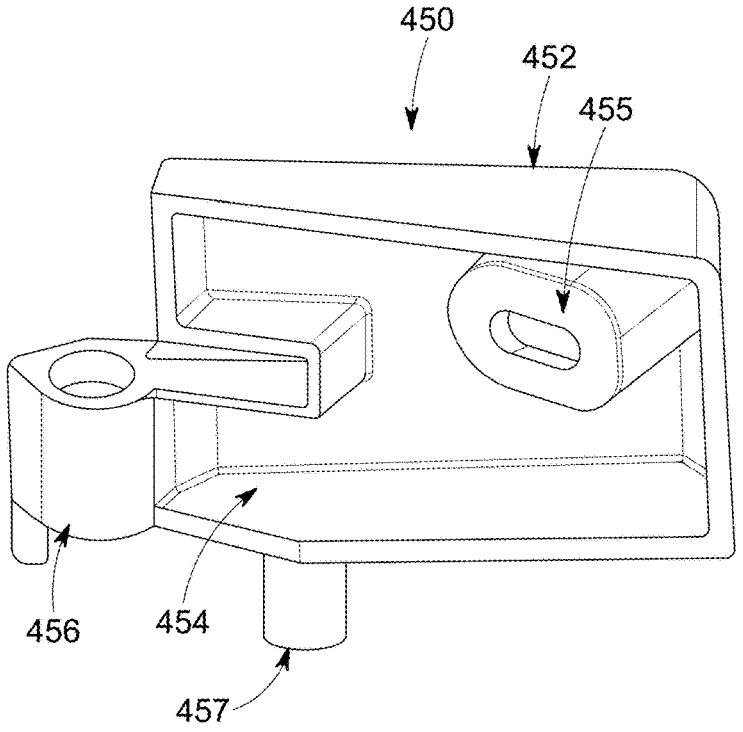

More specifically, and now turning to FIGS. 19 and 20, in the depicted embodiment the flexible diverter 404 includes a base piece 430 with couplers 438 that can snap or press fit into the cavity 421. This secures the flexible diverter 404 in the convergent trackway 402 adjacent the twin couplers 412. The base piece 430 has a top surface 432 that sits substantially flush with the bottom surface 420 of the convergent trackway 402 so that the base piece 430 does not impede toy vehicles traveling across the second accessory track piece 400. The flat top surface 432 also allows a remainder of the flexible diverter 404 to easily slide or pivot across the base piece 430. At the same time, the base piece 430 securely couples the flexible diverter 404 to the convergent trackway 402 so that a force imparted to the flexible diverter 404 by a toy vehicle does not remove or dislodge the flexible diverter 404. In some embodiments, this secure coupling may be a fixed coupling (e.g., one way detents), but in other embodiments it may be a removably coupling.

Now turning to FIGS. 21-24, regardless of how the flexible diverter 404 is coupled to the second accessory track piece 400, the flexible diverter 404 includes a first vehicle guide 440 and a second vehicle guide 450 that are movably coupled to each other and movably coupled to the base piece 430. The movable coupling between the base piece 430 and vehicle guides 440, 450 allows the vehicle guides 440, 450 to move between different gate positions (see, e.g., FIGS. 25B and 25D) that "gate" or block one of the two paths at the entry end of the convergent trackway 402. Meanwhile, the movable coupling between the first vehicle guide 440 and the second vehicle guide 450 allows the first vehicle guide 440 and the second vehicle guide 450 to move towards and away from each other, between a rest position (see, e.g., FIG. 25A) and a compressed configuration (see, e.g., FIG. 25C). Each of these positions and configurations is detailed further below.

In the depicted embodiment, the structures of the first vehicle guide 440 and the second vehicle guide 450 allow the flexible diverter 404 to move between these various positions and configurations. Specifically, the first vehicle guide 440 includes an external guide surface 442 configured to contact a toy vehicle and an internal surface 444 that faces the second vehicle guide 450. The external guide surface 442 may have a taper, slope, or angle to fit the specific convergent trackway 402 in which it is included, but the shaping shown in the Figures is not intended to be limiting. The internal surface 444 includes a lateral post 445 that extends laterally away from the internal surface 444, towards the vehicle guide 450. Additionally, the first vehicle guide 440 includes an axle 446 configured to engage the base piece 430.

Meanwhile, the second vehicle guide 450 includes an external guide surface 452 configured to contact a toy vehicle and an internal surface 454 that faces the first vehicle guide 440. Again, the external guide surface 452 may have a taper, slope, or angle to fit the specific convergent trackway 402 in which it is included, but the shaping shown in the Figures is not intended to be limiting. The second vehicle guide 450 also includes a receiver 456 at its upstream end and a cam 457 extending downwards from its bottom surface. The receiver 456 is configured to be mounted onto the axle 446 of the first vehicle guide 440. Then, the axle 446 can be installed in an axle receiver 436 of the base piece 430. This creates a common, fixed pivot point for the first vehicle guide 440 and the second vehicle guide 450 at an upstream axial end of the first vehicle guide 440 and the second vehicle guide 450. Meanwhile, the cam 457 is configured to ride in an arcuate cam slot 434 which defines a rotational range of the flexible diverter 404.

Additionally, the internal surface 454 of the second vehicle guide 450 includes a boss 455 facing the first vehicle guide 440. The boss 455 is configured to receive the lateral post 445 and slidably secure the internal surface 444 of the first vehicle guide 440 to the internal surface 454 of the second vehicle guide 450, setting a maximum separation distance between the downstream axial ends of the internal surface 444 and the internal surface 454. However, a biasing member 460 is installed between and/or around the lateral post 445 and the boss 455 and is configured to encourage the internal surface 444 of the first vehicle guide 440 to be maximally spaced from the internal surface 454 of the second vehicle guide 450. That is, the biasing member 460 is configured to bias the first vehicle guide 440 and the second vehicle guide 450 to a rest configuration in which the first vehicle guide 440 and second vehicle guide 450 are spread apart (e.g., as wide as possible). In at least some embodiments, the biasing member 460 is a compression spring.

In view of the foregoing features, not only can the first vehicle guide 440 and second vehicle guide 450 pivot around an axis of axle 446, but the first vehicle guide 440 and second vehicle guide 450 can also compress towards each other before rotating or pivoting back away from each other. Among other advantages, this allows the first vehicle guide 440 and/or the second vehicle guide 450 to absorb an impact of a toy vehicle, decreasing the equal and opposite force imparted by flexible diverter 404 onto the toy vehicle during an impact. In turn, this decreases the chances that a toy vehicle will be ejected from the second accessory track piece 400 when the flexible diverter 404 is closing a travel path of the toy vehicle (i.e., when the flexible diverter 404 is in a gate position that blocks the travel path of the toy vehicle).

FIGS. 25A-25D and 26A-26D depict two vehicles in different states of engaging with the flexible diverter 404 in different orders to depict the various positions and configurations of the flexible diverter 404. First, in FIGS. 25A and 26A, a first toy vehicle 501 and a second toy vehicle 502 are approaching the flexible diverter 404 but neither toy vehicle has contacted the external guide surface 442 of the first vehicle guide 440 or the external guide surface 452 of the second vehicle guide 450. Thus, in both FIGS. 25A and 26A, the flexible diverter 404 is in a rest or non-compressed configuration C1 and is a non-gated position P1 that is not blocking either of the lanes at the entry end of the convergent trackway 402. For example, in non-gated position P1, the flexible diverter 404 may hang downwards under the influence of gravity.

Figure 25B:
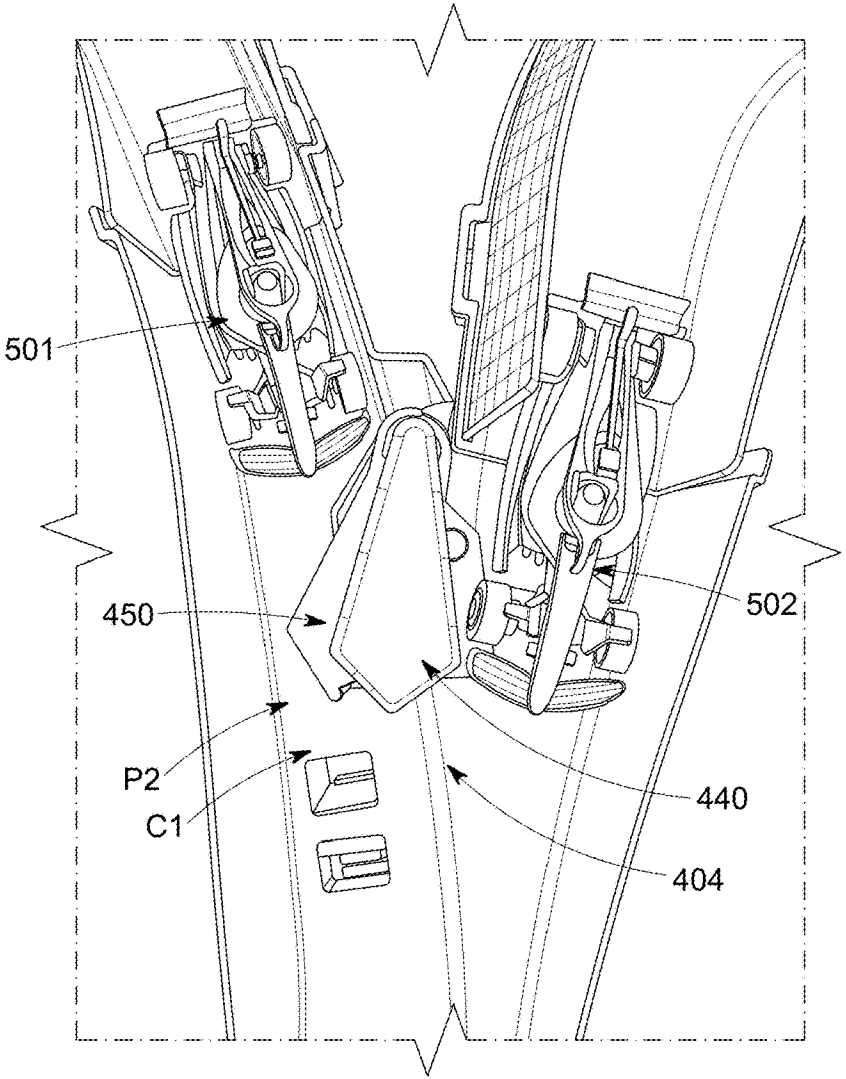
FIGS. 25A-25D and 26A-26D illustrate interplay between two toy vehicles and the flexible diverter as the two toy vehicles move through the second accessory track piece of FIG. 21 in different manners.
Figure 25A:
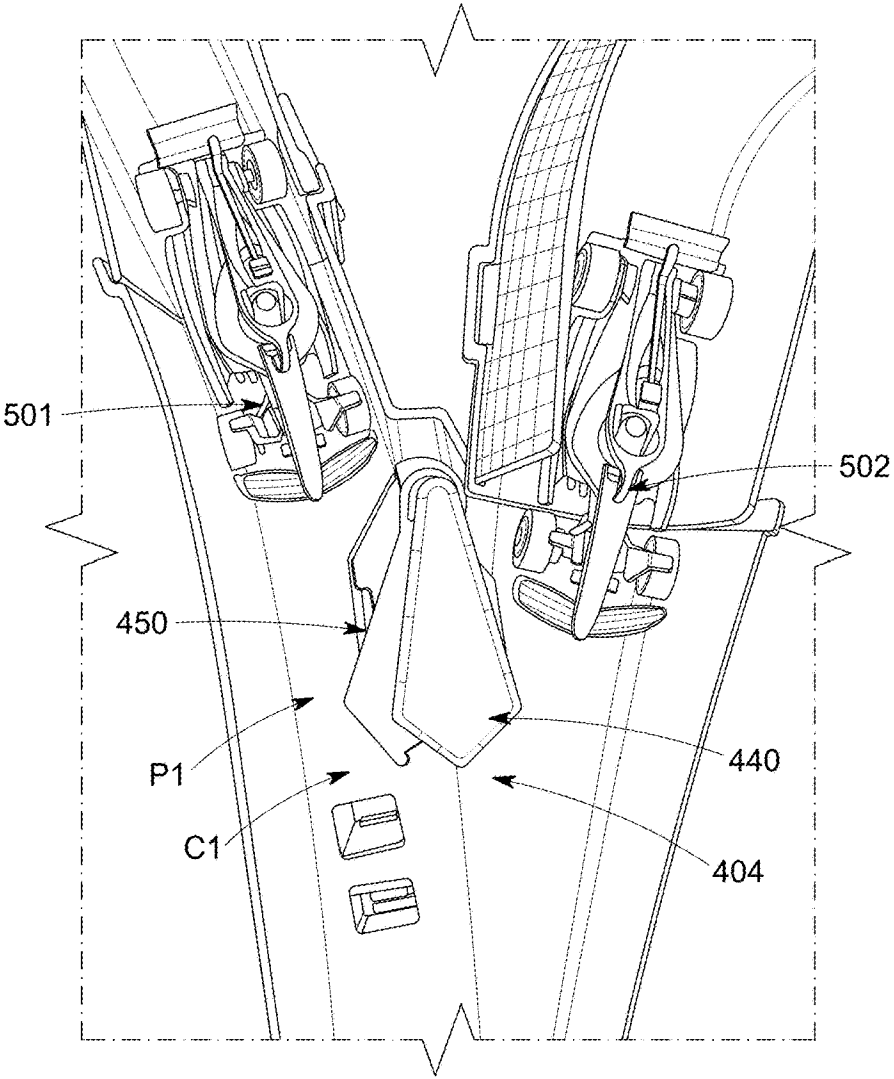

In FIG. 25B, the second toy vehicle 502 moves ahead of the first toy vehicle 501 and contacts the flexible diverter 404 before the first toy vehicle 501. Specifically, the second toy vehicle 502 contacts the external guide surface 442 of the first vehicle guide 440. This pushes the first vehicle guide 440 and second vehicle guide 450 of the flexible diverter 404 to pivot around axle 446, into a first gate position P2 that blocks or impedes the first toy vehicle 501 from traveling forwards along the convergent trackway 402.

Figure 26B:
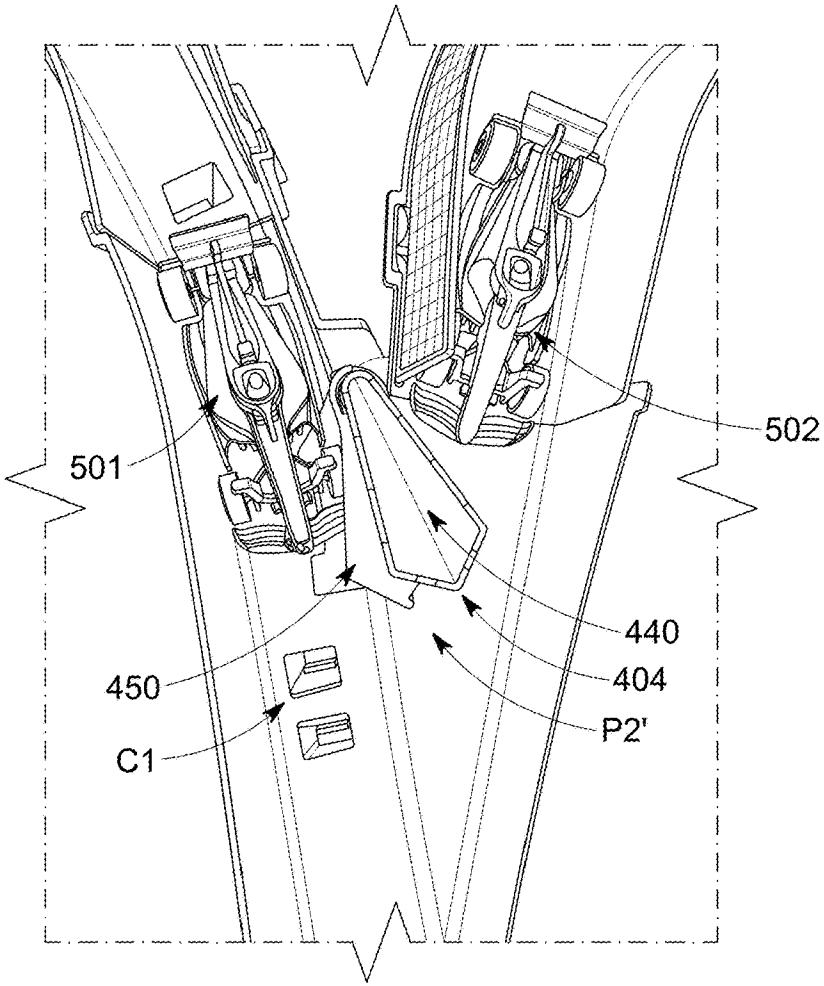
Figure 26A:
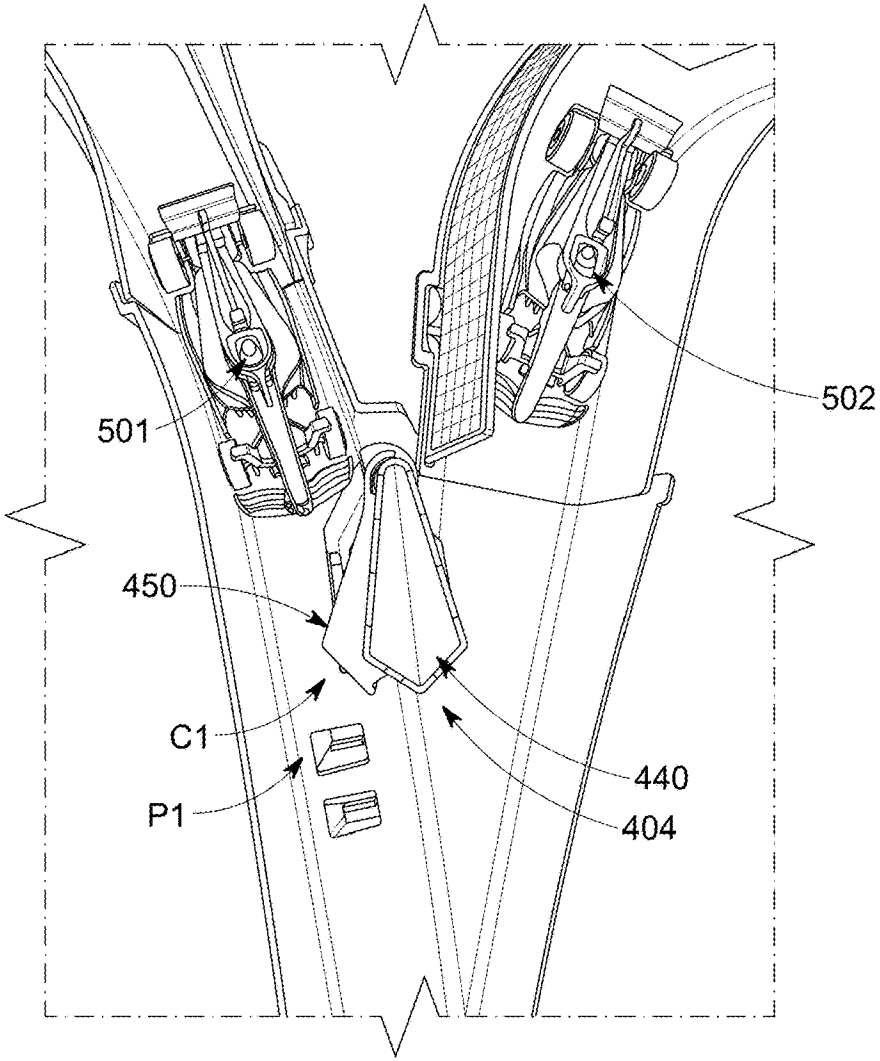

By comparison, in FIG. 26B, the first toy vehicle 501 moves ahead of the second toy vehicle 502 and contacts the flexible diverter 404 before the second toy vehicle 502. Specifically, the first toy vehicle 501 contacts the external guide surface 452 of the second vehicle guide 450. This pushes the first vehicle guide 440 and second vehicle guide 450 of the flexible diverter 404 to pivot around axle 446, into a second gate position P2' that blocks or impedes the second toy vehicle 502 from traveling forwards along the convergent trackway 402.

When a toy vehicle contacts the flexible diverter 404 in its gate position P2 of P2', the toy vehicle does not simply stop on impact. Instead, the compressibility of the flexible diverter 404 allows the flexible diverter 404 to absorb and blunt the impact. For example, moving from FIG. 25B to FIG. 25C, when the first toy vehicle 501 moves into contact with the second vehicle guide 450 in its gated position, the force of the toy vehicle overcomes the outward force of biasing member 460 and compresses the second vehicle guide 450 against the first vehicle guide 440, moving the flexible diverter 404 into its compressed configuration C2. The compressed configuration C2 will not necessarily create enough room for the first toy vehicle 501 and the second toy vehicle 502 to pass the flexible diverter 404 at the same time, but it may sufficiently blunt the impact force imparted to first toy vehicle 501 (which is the latter/slower toy vehicle in this instance) to retain the first toy vehicle 501 on the convergent trackway 402 (avoiding ejection of the first toy vehicle 501). A similar scenario occurs moving from FIG. 26B to FIG. 26C, except that in these Figures the second toy vehicle 502 is the latter/slower/trailing vehicle and the flexible diverter 404 blunts or decreases the impact force imparted to the second toy vehicle 502 by the first vehicle guide 440.

Figure 25D:
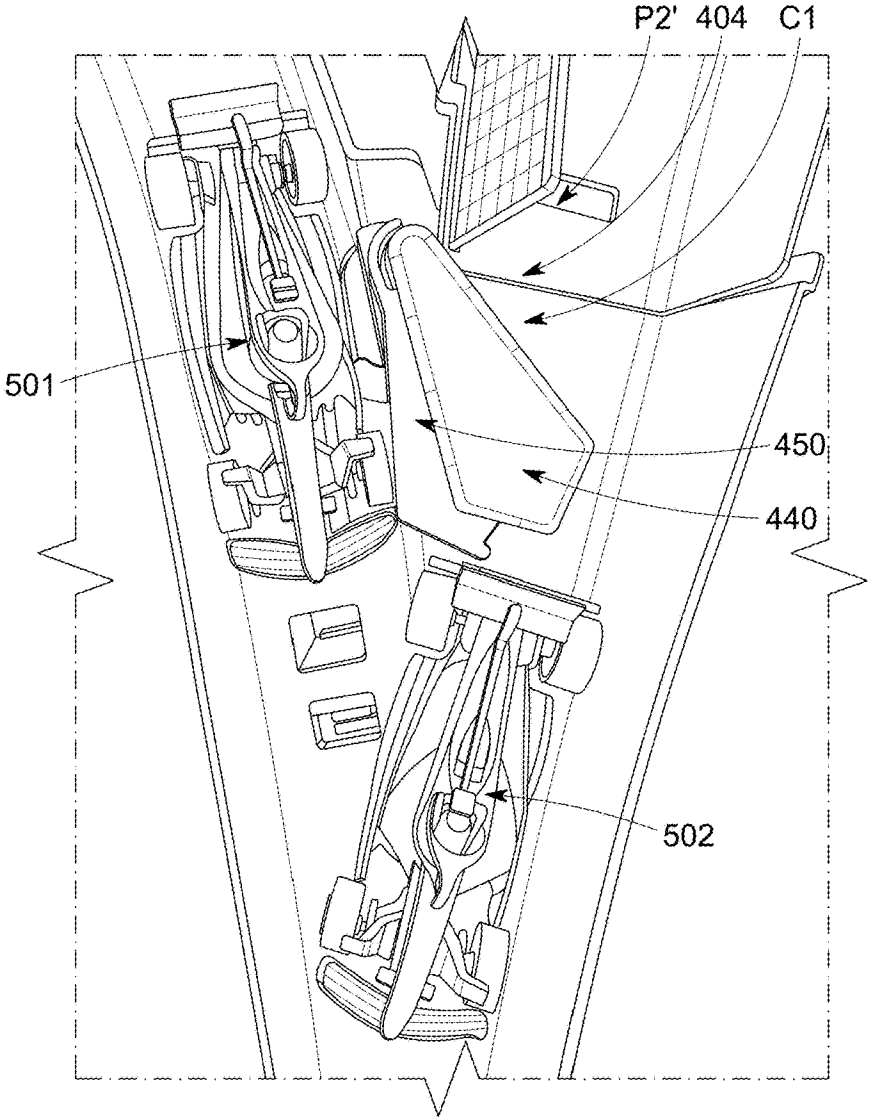
Figure 25C:
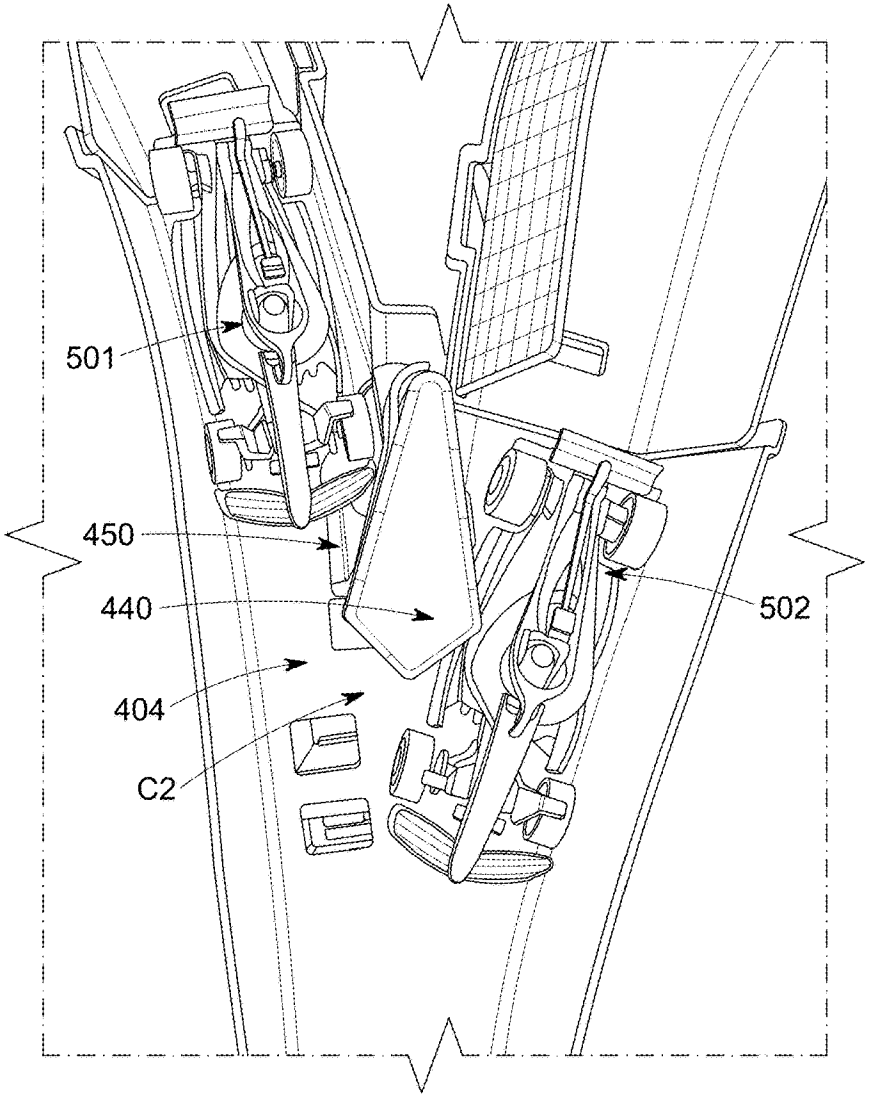
Figure 26D:
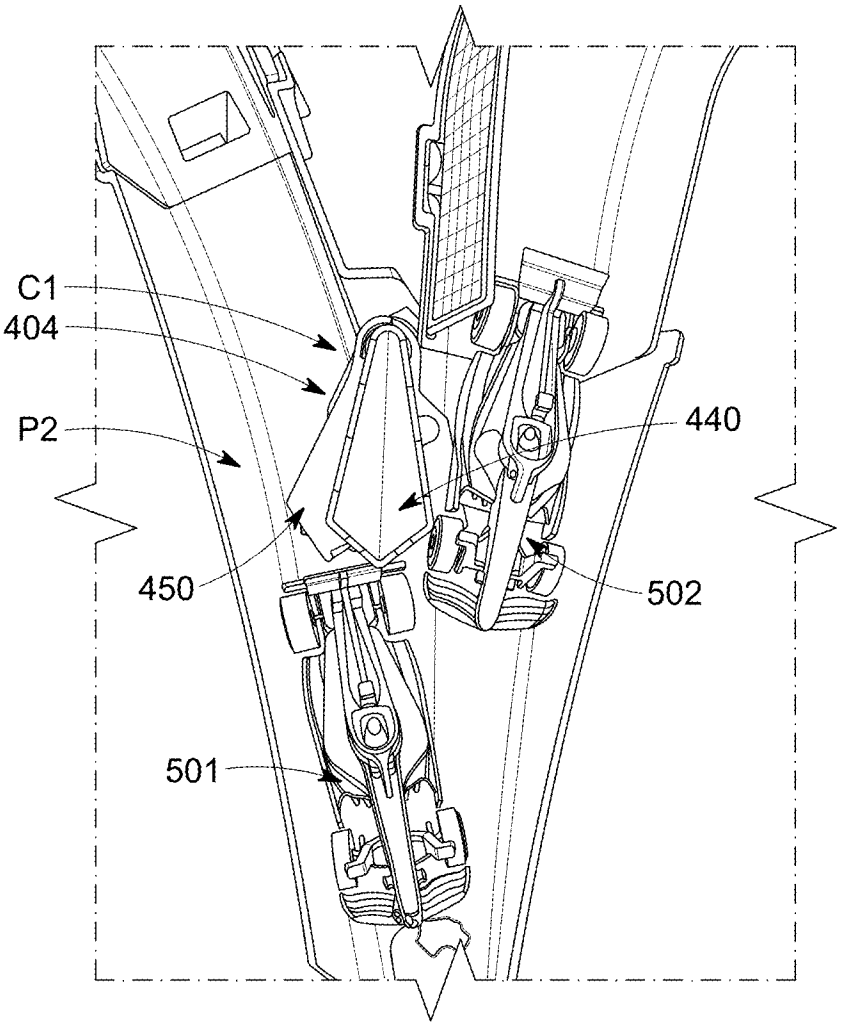
Figure 26C:
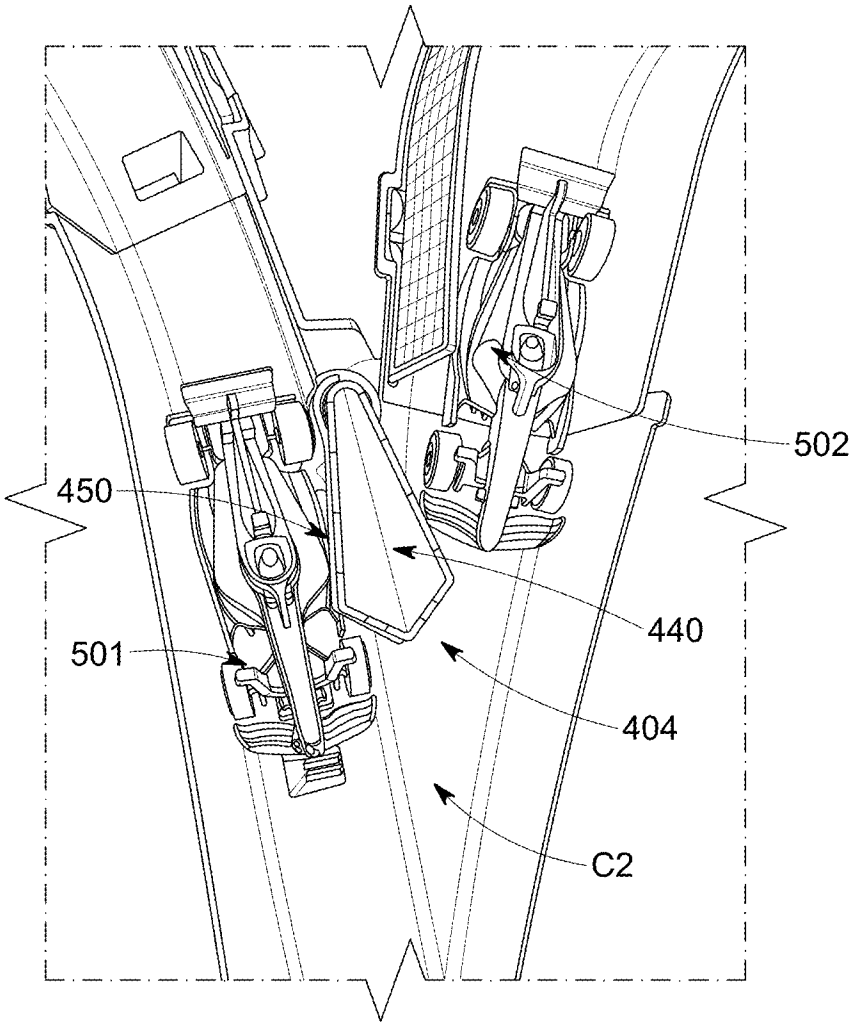

Now turn to FIGS. 25D and 26D, once a first/leading/faster toy vehicle has moved past the flexible diverter 404, the flexible diverter 404 is free to move to an opposite gated position to allow the second/trailing/slower toy vehicle to drive past the flexible diverter 404. More specifically, moving from FIG. 25C to FIG. 25D, once the second toy vehicle 502 clears the flexible diverter 404, the compression forces acting on the flexible diverter 404 may abate and the flexible diverter 404 may move back to its rest configuration C1. Additionally, with the second toy vehicle 502 out of the way, the first toy vehicle 501 may push the flexible diverter 404 to pivot in an opposite direction, to or towards a second gate position P2' that blocks the pathway previously traversed by second toy vehicle 502. An opposite but identical process may occur moving from FIG. 26C to FIG. 26D.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle track configuration, comprising:

a closed loop track extending from a first end to a second end;

a booster including a booster wheel configured to engage and propel a toy vehicle along the closed loop track, the booster wheel being positioned to both: (i) propel the toy vehicle towards the second end as the toy vehicle moves from the first end towards the second end; and (ii) propel the toy vehicle towards the first end as the toy vehicle moves from the second end towards the first end; and a flexible diverter configured to guide the toy vehicle and an additional toy vehicle towards the booster in sequence as the toy vehicle and the additional toy vehicle move from the first end towards the second end, the flexible diverter being configured to pivot between gate positions and also being configured to move between a rest position in which the flexible diverter has a first width and a compressed position in which the flexible diverter has a second width smaller than the first width.

2. The toy vehicle track configuration of claim 1, wherein the flexible diverter moves to one of the gate positions when contacted by one of the toy vehicle or the additional toy vehicle.

3. The toy vehicle track configuration of claim 2, wherein the flexible diverter moves from the rest position to the compressed position when contacted by both of the toy vehicle and the additional toy vehicle.

4. The toy vehicle track configuration of claim 3, wherein, by moving from the rest position to the compressed position, the flexible diverter reduces an impact force applied by the flexible diverter to a latter toy vehicle of the toy vehicle and the additional toy vehicle to impact the flexible diverter, and wherein a reduction in the impact force discourages the latter toy vehicle from exiting the closed loop track in response to impacting the flexible diverter.

5. The toy vehicle track configuration of claim 1, wherein the booster includes a first pathway and a second pathway, the first pathway being configured to direct the toy vehicle into contact with the booster wheel as the toy vehicle moves from the second end towards the first end and the second pathway being configured to direct the toy vehicle into contact with the booster wheel as the toy vehicle moves from the first end towards the second end.

6. The toy vehicle track configuration of claim 5, wherein the booster further comprises a second booster wheel, the booster wheel extending into the second pathway along a first side of the second pathway and the second booster wheel extending into the second pathway along a second side of the second pathway, opposite the first side of the second pathway.

7. The toy vehicle track configuration of claim 6, wherein the booster wheel and the second booster wheel rotate in opposite rotational directions.

8. The toy vehicle track configuration of claim 5, wherein the booster further comprises a third pathway positioned to allow the toy vehicle to move through the booster without contacting the booster wheel.

9. The toy vehicle track configuration of claim 8, wherein the booster further comprises a third booster wheel positioned to propel the toy vehicle towards the first end as the toy vehicle moves along the third pathway from the second end towards the first end.

10. The toy vehicle track configuration of claim 9, wherein the booster wheel and the third booster wheel rotate in opposite rotational directions.

11. A toy vehicle accessory track piece, comprising:

a main body defining a first pathway, a second pathway, and a third pathway that extend through the main body in parallel, with the first pathway between the second pathway and the third pathway;

a booster wheel positioned between the first pathway and the second pathway, the booster wheel being configured to both: (i) engage and propel a toy vehicle in a first direction as the toy vehicle moves along the first pathway; and (ii) engage and propel the toy vehicle in a second direction, opposite the first direction, as the toy vehicle moves along the second pathway; and an additional booster wheel positioned exteriorly of the third pathway as a single booster wheel for the third pathway, the additional booster wheel being configured to engage and propel the toy vehicle in the first direction, without assistance of the booster wheel or another booster wheel, as the toy vehicle moves along the third pathway.

12. The toy vehicle accessory track piece of claim 11, wherein the booster wheel is configured to engage and propel the toy vehicle in the first direction as the toy vehicle moves along the first pathway while simultaneously engaging and propelling an additional toy vehicle in the second direction as the additional toy vehicle moves along the second pathway.

13. The toy vehicle accessory track piece of claim 11, further comprising:

a second booster wheel, the booster wheel extending into the second pathway along a first side of the second pathway and the second booster wheel extending into the second pathway along a second side of the second pathway, opposite the first side of the second pathway, the booster wheel and the second booster wheel rotating in opposite rotational directions to collectively engage and propel the toy vehicle in the second direction.

14. The toy vehicle accessory track piece of claim 11, wherein the booster wheel and the additional booster wheel rotate in opposite rotational directions so that the booster wheel can propel the toy vehicle in the first direction while engaging a first side of the toy vehicle and the additional booster wheel can both propel the toy vehicle in the first direction while engaging a second side of the toy vehicle.

15. A toy vehicle accessory track piece, comprising a flexible diverter configured to:

pivot between gate positions that each open one toy vehicle path while closing another toy vehicle path, wherein the flexible diverter moves to one of the gate positions when contacted by a single toy vehicle; and move between a rest position in which the flexible diverter has a first width and a compressed position in which the flexible diverter has a second width smaller than the first width, wherein the flexible diverter moves from the rest position to the compressed position when contacted by two toy vehicles.

16. The toy vehicle accessory track piece of claim 15, further comprising:

a track piece with a convergent track pathway including an entrance that allows the two toy vehicles to enter the track piece in parallel and an exit that forces the two toy vehicles to exit the track piece in sequence.

17. The toy vehicle accessory track piece of claim 15, wherein, by moving from the rest position to the compressed position, the flexible diverter reduces an impact force applied by the flexible diverter to a latter toy vehicle of the two toy vehicles to impact the flexible diverter, and wherein a reduction in the impact force discourages the latter toy vehicle from exiting a track piece in response to impacting the flexible diverter.

18. The toy vehicle accessory track piece of claim 15, wherein the flexible diverter comprises a first vehicle guide movably coupled to a second vehicle guide via a biasing member, the biasing member biasing the first vehicle guide and the second vehicle guide to the rest position while allowing the first vehicle guide and the second vehicle guide to move towards each other to move into the compressed position.

* * * * *